US007922838B2

(12) United States Patent
Usami et al.

(10) Patent No.: US 7,922,838 B2
(45) Date of Patent: Apr. 12, 2011

(54) CRUDE OIL TANK FABRICATED FROM STEEL PLATE

(75) Inventors: Akira Usami, Futtsu (JP); Kenji Katoh, Futtsu (JP); Toshiei Hasegawa, Oita (JP); Akira Shishibori, Oita (JP)

(73) Assignee: Nippon Steel Corporation, Tokyo (JP)

( * ) Notice: Subject to any disclaimer, the term of this patent is extended or adjusted under 35 U.S.C. 154(b) by 458 days.

(21) Appl. No.: 10/518,664

(22) PCT Filed: Jun. 18, 2003

(86) PCT No.: PCT/JP03/07751

§ 371 (c)(1),
(2), (4) Date: Dec. 17, 2004

(87) PCT Pub. No.: WO04/001083

PCT Pub. Date: Dec. 31, 2003

(65) Prior Publication Data

US 2005/0230012 A1 Oct. 20, 2005

(30) Foreign Application Priority Data

Jun. 19, 2002 (JP) ..... 2002-178659
Jun. 19, 2002 (JP) ..... 2002-178806
Oct. 29, 2002 (JP) ..... 2002-314527
May 16, 2003 (JP) ..... 2003-138374

(51) Int. Cl.
*C22C 38/12* (2006.01)
*C22C 38/16* (2006.01)
*C22C 38/06* (2006.01)
*C22C 38/60* (2006.01)

(52) U.S. Cl. ..... 148/332; 148/336; 420/89; 420/93; 420/92; 420/128

(58) Field of Classification Search ..... 148/320, 148/654, 332–336; 420/89–93, 128
See application file for complete search history.

(56) References Cited

U.S. PATENT DOCUMENTS 3,733,195 A * 5/1973 Nishi et al. ..... 420/84
(Continued)

FOREIGN PATENT DOCUMENTS

CN 1148416 A 4/1997
(Continued)

OTHER PUBLICATIONS

Machine-English translation of Japanese patent 2001-214236, Ito Minoru et al., Aug. 7, 2001.*

(Continued)

*Primary Examiner* — Deborah Yee
(74) *Attorney, Agent, or Firm* — Kenyon & Kenyon LLP

(57) ABSTRACT

The present invention provides: a steel for a welded structure to be used for a crude oil tank that exhibits excellent general and local corrosion resistance in crude oil corrosion caused in a steel oil tank and is capable of suppressing the formation of corrosion products (sludge) containing solid sulfur; a method for producing said steel; a crude oil tank; and a method for preventing a crude oil tank against corrosion. The present invention makes it possible to obtain general and local corrosion resistance in a crude oil tank environment and suppress the formation of corrosion products (sludge) containing solid sulfur by using a steel: containing, in mass, 0.001 to 0.2% C, 0.01 to 2.5% Si, 0.1 to 2% Mn, 0.03% or less P, 0.007% or less S, 0.01 to 1.5% Cu, 0.001 to 0.3% Al, 0.001 to 0.01% N as basic components and, further, 0.01 to 0.2% Mo and/or 0.01 to 0.5% W; and preferably satisfying the following expression;

Solute Mo+Solute W≧0.005%.

18 Claims, 6 Drawing Sheets

U.S. PATENT DOCUMENTS

| | | | | |
|---|---|---|---|---|
| 4,407,681 | A * | 10/1983 | Ina et al. | 148/570 |
| 5,993,570 | A * | 11/1999 | Gray | 148/320 |
| 6,238,493 | B1 | 5/2001 | Lin et al. | |
| 2003/0062101 | A1 | 4/2003 | Kimura et al. | |

FOREIGN PATENT DOCUMENTS

| | | | |
|---|---|---|---|
| DE | DD 241 534 | | 12/1986 |
| EP | 0 709 480 | A1 | 5/1996 |
| EP | 1 460 145 | A1 | 9/2004 |
| JP | 48-050917 | | 7/1973 |
| JP | 48-050921 | | 7/1973 |
| JP | 48-050922 | | 7/1973 |
| JP | 49-003808 | | 1/1974 |
| JP | 49-052117 | | 5/1974 |
| JP | 49-027709 | | 7/1974 |
| JP | 50-158515 | | 12/1975 |
| JP | 52-011118 | | 1/1977 |
| JP | 58-107476 | | 6/1983 |
| JP | 59-74219 | | 4/1984 |
| JP | 62-243738 | | 10/1987 |
| JP | 01-149923 | | 6/1989 |
| JP | 02-022416 | | 1/1990 |
| JP | 7-310141 | | 11/1995 |
| JP | 08-246048 | | 9/1996 |
| JP | 10-017929 | | 1/1998 |
| JP | 10-147839 | | 6/1998 |
| JP | 2000-017381 | | 1/2000 |
| JP | 2001-107179 | | 4/2001 |
| JP | 2001-107180 | | 4/2001 |
| JP | 2001-123243 | | 5/2001 |
| JP | 2001-214236 | | 8/2001 |
| JP | 2001-288512 | | 10/2001 |
| JP | 2002-12940 | * | 1/2002 |
| JP | 2002-173736 | | 6/2002 |
| JP | 2002-327212 | | 11/2002 |
| JP | 2003-13138 | | 1/2003 |
| JP | 2003-082435 | | 3/2003 |
| JP | 2003-105467 | | 4/2003 |

OTHER PUBLICATIONS

Machine-English translation of Japanese patent 10-017929, Kobayashi Kazutaka et al., Jan. 20, 1998.*
Machine-English translation of Japanese patent 2001-288512, Toshinaga et al., Oct. 19, 2001.*
Machine-English translation of Japanese patent 10-147839, Katsumi et al., Jun. 2, 1998.*
International Search Report dated Sep. 30, 2003 issued in corresponding PCT Application No. PCT/JP03/07751.
I. Matsushima, "*Corrosion-Resistant Low-Alloy Steel*," published from Chijin Shokan in 1995, p. 117 (partial English Translation).
"*Recommended Practice of Corrosion Control and Protection in Aboveground Oil Storage Tank HPIS G*," published by High Pressure Institute of Japan in 1989-1990, p. 18 (partial English Translation).
European Opposition dated Jan. 25, 2010 issued in corresponding European Patent Application EP 03 76 0884.1 filed by ThyssenKrupp Steel Europe AG.
"Temperaturverlauf " [*march of temperature*] by Joachim Degenkolbe and Udo Schriever, Maschinenmarkt, Wurzburg 94 (1988) 44, pp. 66-68, 70-71.
European Opposition dated Jan. 25, 2010 issued in corresponding European Patent Application EP 03 76 0884.1 filed by Aktiengesellschaft der Dillinger Huttenwerke.
"Development of Ferritic Stainless Steel YUS 450 with High Heat Reistance for Automotive Exhaust System Components," Nippon Steel Technical Report No. 71, Oct. 1996.
Data sheet for DI-MC 355 steel dated Feb. 1996.
Test certificate for DI-MC355T steel dated Aug. 17, 1999.
Test certificate for DI-MC355T steel dated Feb. 10, 2000.
Approval report of Jun. 24, 1994 (partial translation).
Transparency presented at the Dillinger Hutte GTS I. Symposium "Modern Steels for Boilers & Pressure Vessels," Nov. 9, 1998, Madrid.
"Neue Eigenschaftskombinationen an Grobblech durch den beschleunigten Kuhlprozess," [*new property combinations in plate through the accelerated cooling process*] in Stahl and Eisen [*Steel and Iron*] 119 (1999) No. 3 (partial translation).
Standard EN 10052: 1993 (partial translation).
"Werkstoffjunde Stahl" [*material science steel*], ISBN 3-540-13084-5, 1985 (partial translation).
European Opposition dated Jan. 22, 2010 issued in corresponding European Patent Application EP 03 76 0884.1 filed by Corus UK Ltd.
Inspection Certificate dated Aug. 14, 2001.
Inspection Certificate dated May 16, 2002.
Inspection Certificate dated Jun. 1, 2002.
The RQT Series - BSC Plates, Published 1982, Sales Brochure of BSC Plates.
RQT Plate, published 1989, Sales Brochure of British Steel.
RQT 701 High Strength Steel Plate, published 1989, Sales Brochure of British Steel.
"Newly developed 80 kg/mm2 class high-strength quenched and tempered steel plates with heavy sections," paper in Conference proceedings of International Conference on Technology Applications of HSLA Steels, 1983.
"Investigation of centreline Segregation and Centreline Porosity in CC-Slabs," H.F. Jacobi, Steel Research 74 (2003), pp. 667-678.
"Qualitatsentwicklung bei sauergasbestandigen Grossrohrstehlen. Vermeidung der Mittenseigerung sowie der Ausscheidung von Mangansulfid and primarem Niocarbonitrid," H.F. Jacobi, TU Clausthal, Clausthal-Zellerfeld, 1991.
Test Certificate: DALZ/02/00671299/1, Jul. 3, 2002 (partial translation).
Test Certificate: DALZ/02/00672420/1, Jul. 12, 2002.
Test Certificate: DALZ/02/00672453/1, Jul. 12, 2002.
Standard: A841/A 841M, published Dec. 1998.
"The Making, Shaping and Treating of Steel," 1985, Association of Iron and Steel Engineers (ISBN 0-930767-00-4), p. 1127.
"Elements of Materials Science & Engineering," L.H. van Vlack, Addison-Wesley World Student Series, 1980 (ISBN 0-201-08081-8), pp. 416, 431-433.
"Engineering in Process Metallurgy," R.I.L. Guthrie, 1989 (ISBN 0-19-856222-5), pp. 10-11.
"Steel Treatment Handbook," G.E. Totten, M.A.H. Howes, 1997 (ISBN 0-8247-9750-7), pp. 167-168.
Sigmashield 420, Sigma Multiguard, Jan. 2008, pp. 1-4.

* cited by examiner

CRUDE OIL TANK FABRICATED FROM STEEL PLATE

TECHNICAL FIELD

The present invention relates to: a steel for a welded structure to be used for a crude oil tank such as an oil tank of a crude oil carrier or an aboveground or underground crude oil tank, the steel exhibiting excellent resistance to the corrosion that is caused by crude oil and occurs in a steel oil tank for transporting or storing crude oil and being capable of suppressing the formation of a corrosion product (sludge) containing solid sulfur; a method for producing the steel; a crude oil tank; and a method for protecting the crude oil tank against corrosion.

BACKGROUND ART

A steel for a welded structure excellent in strength and weldability is used for a steel oil tank, such as an oil tank of a crude oil carrier or an aboveground or underground crude oil tank, for transporting or storing crude oil. The problems to be solved in relation to corrosion damage of a crude oil tank have been: 1) to alleviate corrosion of steel plates, especially to alleviate local corrosion damage in the form of pitting that progresses at a comparatively high rate; and 2) to reduce the amount of solid sulfur that precipitates on the surfaces of steel plates in a gas phase and causes sludge to form. These problems are outlined below.

1) Alleviation of Corrosion of Steel Plates

The inside of a crude oil tank is exposed to a corrosive environment caused by water, salts and corrosive gas components contained in crude oil (cf. Recommended Practice of Corrosion Control and Protection in Aboveground Oil Storage Tank HPIS G, p. 18 (1989-90), published by the High Pressure Institute of Japan, and SR242—Study on Cargo Oil Tank Corrosion of Oil Tanker, Outline of Research Activities in Fiscal Year 2000 of the Shipbuilding Research Association of Japan). A peculiar corrosive environment forms especially on the inside of an oil tank of a crude oil carrier because of elements such as volatile components of crude oil, contaminating seawater, salts in oil field brine, the marine engine exhaust gas called inert gas that is introduced to the tank for preventing explosions, and water condensation caused by the temperature fluctuation between daytime and nighttime. In such an environment, a steel is damaged by general corrosion and local corrosion in the form of pitting.

As a result, corrosion cavities roughly 10 to 30 mm in diameter form in quantities on the floor plate of an oil tank of a crude oil carrier, and the corrosion cavities progress at a rate of 2 to 3 mm per year. This is far greater than the average rate of thickness loss caused by corrosion, 0.1 mm per year, which is taken into consideration in the design of a hull. The local corrosion of structural members of a crude oil tank is particularly detrimental, because when corrosion progresses locally, loads on the corroded portions increase beyond what is expected in the design, and large strain and/or plastic deformation occur(s), leading to possible destruction of the whole structure. Thus, countermeasures against local corrosion are indispensable. In addition, it is difficult to predict the location of local corrosion and its rate of progress. For these reasons, development of a steel for a welded structure excellent in strength and weldability and, at the same time, having good corrosion resistance especially capable of decreasing the progress rate of local corrosion has been in demand.

2) Reduction of the Amount of Solid Sulfur That Precipitates on the Surfaces of Steel Plates in a Gas Phase and Causes Sludge to Form In addition to the corrosion damage mentioned above, a large quantity of solid sulfur forms and precipitates on the internal surface of a steel oil tank, especially on the reverse side surface of a steel plate of an upper deck (deck plate). This is because $SO_2$ and $H_2S$ in a gas phase react and form solid sulfur, with the iron rust on a corroded steel plate surface acting as a catalyst. The formation of fresh rust resulting from the corrosion of a steel plate and the precipitation of solid sulfur take place alternately and, as a result, a multi-layered corrosion product composed of iron rust and solid sulfur forms. Since a solid sulfur layer is brittle, the corrosion product composed of iron rust and solid sulfur easily exfoliates, falls off and accumulates as sludge at the bottom of an oil tank. The amount of sludge collected from a very large crude oil carrier during a periodical inspection is reported to amount to 300 tons or more, and for that reason, reduction of the amount of sludge composed mainly of solid sulfur has been required from the viewpoint of maintenance.

Corrosion prevention by painting and lining has generally been employed as a technique for protecting a steel material against corrosion and simultaneously decreasing sludge composed mainly of solid sulfur, and corrosion prevention by spraying zinc and/or aluminum has also been proposed (cf. Recommended Practice of Corrosion Control and Protection in Aboveground Oil Storage Tank HPIS G, p. 18 (1989-90), published by the High Pressure Institute of Japan). However, in addition to the economical problems of the time and costs involved in re-painting the reverse side of all the deck plates of a very large crude oil carrier, there has also been a technical problem in that protection by painting and/or lining also requires periodical inspections and repair, because corrosion inevitably progresses as a result of microscopic defects caused during the application of protective layers and age-related degradation.

Despite the above, no technology to suppress the precipitation of solid sulfur on a steel plate surface by improving the corrosion resistance of the steel plate itself in a crude oil tank environment has been disclosed. In this situation, in the field of a steel for a welded structure such as an oil tank, development of a steel for a welded structure excellent in corrosion resistance and capable of suppressing the formation of sludge mainly composed of solid sulfur has been in demand from the viewpoints of enhancing the reliability and extending the service life of the structure.

Here, an overview is given below regarding technologies so far proposed to solve the problems 1) and 2) above, peripheral technologies proposed in relation thereto and problems involved in the proposed technologies.

1) Measures to Alleviate Corrosion of Steel Plates and Problems of Conventional Technologies Technologies so far proposed to alleviate corrosion, especially local corrosion, of a steel plate occurring on the inside of a crude oil tank are described below. Ordinary steels for welded structures have generally been used without protective coating for a crude oil tank, either that of a crude oil carrier or that constructed aboveground or underground. Painting has conventionally been the most commonly employed corrosion prevention method, and protective painting with an epoxy resin and/or zinc rich primer, heavy-duty coating with an epoxy resin mixed with glass flakes and the like have been proposed for this purpose. Besides these, hot dip galvanized steels with paint coating have been used for handrails and piping of an oil carrier in view of its excellent corrosion resistance in an environment where the steels are alternately exposed to seawater and crude oil. In addition to the above, the following technologies have been proposed to provide corrosion-resistant steels having better corrosion resistance than ordinary steels do and being suitable for use in the interior of a crude oil tank.

Japanese Unexamined Patent Publication No. S50-158515 proposes a Cu—Cr—Mo—Sb steel as a steel for an oil loading pipe on the basis that the steel exhibits excellent corrosion resistance in an environment where a steel, such as an oil loading pipe, is exposed to crude oil and seawater alternately or simultaneously. The corrosion-resistant steel disclosed in the publication contains 0.2 to 0.5% Cr as a main component and, in addition, 0.1 to 0.5% Cu, 0.02 to 0.5% Mo, and 0.01 to 0.1% Sb.

Japanese Unexamined Patent Publication No. 2000-17381 proposes a Cu—Mg steel as a corrosion-resistant steel for shipbuilding on the basis that the steel exhibits excellent corrosion resistance in an environment where a steel is used for a hull outer plate, a ballast tank, an oil tank (crude oil tank) of a crude oil carrier, or a cargo hold of an ore/coal carrier. The corrosion-resistant steel disclosed in the publication contains 0.01 to 2.0% Cu and 0.0002 to 0.0150% Mg as main components and, in addition, 0.01 to 0.25% C, 0.05 to 0.50% Si, 0.05 to 2.0% Mn, 0.10% or less P, 0.001 to 0.10% S, and 0.005 to 0.10% Al.

Japanese Unexamined Patent Publication No. 2001-107179 proposes a high-P—Cu—Ni—Cr-high-Al steel as a corrosion-resistant steel for an oil loading tank on the basis that the steel exhibits excellent corrosion resistance at the reverse side of the deck plate of an oil loading tank and low welding crack sensitivity. The corrosion-resistant steel disclosed in the publication contains 0.04 to 0.1% P, 0.005% or less S, 0.1 to 0.4% Cu, 0.05 to 0.4% Ni, 0.3 to 4% Cr and 0.2 to 0.8% Al as main components and, in addition, 0.12% or less C, 1.5% or less Si and 0.2 to 3% Mn, and satisfies the expression Pcm≦0.22, where Pcm=[% C]+[% Si]/30+[% Mn]/20+[% Cu]/20+[% Ni]/60+[% Cr]/20+[% Mo]/15+[% V]/10+5[% B].

Japanese Unexamined Patent Publication No. 2001-107180 proposes a low-P—Cu—Ni—Cr-high-Al steel as a corrosion-resistant steel for an oil loading tank on the basis that the steel exhibits excellent corrosion resistance at the reverse side of the deck plate of an oil loading tank, as well as being excellent in a balance between mechanical properties and weldability at large-heat-input welding exceeding 100 kJ. The corrosion-resistant steel disclosed in the publication contains 0.035% or less P, 0.005% or less S, 0.1 to 0.4% Cu, 0.05 to 0.4% Ni, 0.3 to 4% Cr and 0.2 to 0.8% Al as main components and, in addition, 0.12% or less C, 1.5% or less Si and 0.2 to 3% Mn, and satisfies the expression Pcm≦0.22, where Pcm=[% C]+[% Si]/30+[% Mn]/20+[% Cu]/20+[% Ni]/60+[% Cr]/20+[% Mo]/15+[% V]/10+5[% B].

Japanese Unexamined Patent Publication No. 2002-12940 proposes a Cu contained steel, a Cr contained steel and an Ni contained steel as corrosion-resistant steels for oil loading tanks and methods for producing the same on the basis that each of the steels exhibits: excellent corrosion resistance, more specifically, such good durability as to minimize the progress of rust under a primer coating film and thus to extend the service life of the coating film after the application of the primer coating in a corrosive atmosphere at the upper part of an oil loading tank, i.e. in an acid-dew-point corrosive environment caused by corrosive components included in the engine exhaust gas that is introduced into an oil loading tank; and the feature of excellent weldability. Each of the corrosion-resistant steels disclosed in the publication: is used on condition that primer coating is applied; contains one or more of 0.1 to 1.4% Cu, 0.2 to 4% Cr and 0.05 to 0.7% Ni as basic component(s) and, in addition, 0.16% or less C, 1.5% or less Si, 3.0% or less Mn, 0.035% or less P and 0.01% or less S; and satisfies the expression Pcm≦0.22, where Pcm=[% C]+[% Si]/30+[% Mn]/20+[% Cu]/20+[% Ni]/60+[% Cr]/20+[% Mo]/15+[% V]/10+5[% B].

Japanese Unexamined Patent Publication No. 2003-105467 proposes a Cu—Ni steel as a corrosion-resistant steel for an oil loading tank excellent in corrosion resistance at a weld on the basis that the steel exhibits excellent corrosion resistance both at base material after application of primer coating and at a weld to which primer coating is not applied and makes it possible to use an existing welding wire for a carbon steel. The corrosion-resistant steel disclosed in the publication: is used on condition that primer coating is applied; contains 0.15 to 1.4% Cu as a basic component and, in addition, 0.16% or less C, 1.5% or less Si, 2.0% or less Mn, 0.05% or less P and 0.01% or less S; and satisfies the expression Pcm≦0.24, where Pcm=C+Si/30+Mn/20+Cr/20+Cu/20+Ni/60+Mo/15+V/10+5B.

Japanese Unexamined Patent Publication No. 2001-214236 proposes a Cu contained steel, a Cr contained steel, an Mo contained steel, an Ni contained steel, an Sb contained steel, and an Sn contained steel as corrosion-resistant steels for crude oil or heavy oil storage tanks on the basis that each of the steels exhibits excellent corrosion resistance when it is used for a crude oil carrier, an oil tank or the like for storing a liquid fuel or a raw fuel such as crude oil or heavy oil. Each of the corrosion-resistant steels disclosed in the publication contains one or more of 0.01 to 2.0% Cu, 0.01 to 7.0% Ni, 0.01 to 10.0% Cr, 0.01 to 4.0% Mo, 0.01 to 0.3% Sb and 0.01 to 0.3% Sn as basic component(s) and, in addition, 0.003 to 0.30% C, 2.0% or less Si, 2.0% or less Mn, 0.10% or less Al, 0.050% or less P and 0.050% or less S.

Japanese Unexamined Patent Publication No. 2002-173736 proposes a Cu—Ni—Cr steel as a corrosion-resistant steel for a tank for transporting or storing crude oil on the basis that the steel exhibits excellent corrosion resistance. The corrosion-resistant steel disclosed in the publication contains 0.5 to 1.5% Cu, 0.5 to 3.0% Ni and 0.5 to 2.04 Cr as basic components and, in addition, 0.001 to 0.20% C, 0.10 to 0.40% Si, 0.50 to 2.0% Mn, 0.020% or less P, 0.010% or less S and 0.01 to 0.10% Al.

Japanese Unexamined Patent Publication No. 2003-82435 proposes an Ni contained steel and a Cu—Ni steel as steel materials for cargo oil tanks on the basis that each of the steels exhibits excellent corrosion resistance, more specifically, excellent resistance to general corrosion in an environment containing inert gas where wet and dry are repeated alternately. Each of the corrosion-resistant steels disclosed in the publication contains 0.05 to 3% Ni as a basic component and, in addition, 0.01 to 0.3% C, 0.02 to 1% Si, 0.05 to 2% Mn, 0.05% or less P, 0.01% or less S and, as required, one or more of Mo, Cu, W, Ca, Ti, Nb, V, B, Sb, and Sn.

In addition to the above, the following technologies have been proposed regarding corrosion resistant steels for a ballast tank of a marine vessel, although the steels are not for crude oil tank use.

Japanese Examined Patent Publication No. 549-27709 proposes a Cu—W steel and a Cu—W—Mo steel as corrosion-resistant low-alloy steels on the basis that each of the steels exhibits excellent corrosion resistance when used for a ballast tank. Each of the corrosion-resistant steels disclosed in the publication contains 0.15 to 0.50% Cu and 0.05 to 0.5% W basic components and, in addition, 0.2% or less C, 1.0% or less Si, 1.5% or less Mn and 0.1% or less P and, as required, 0.05 to 1.0% Mo.

Japanese Unexamined Patent Publication No. S48-509217 proposes, in patent document 11, a Cu—W steel and a Cu—W—Mo steel as corrosion-resistant low-alloy steels on the basis that each of the steels exhibits excellent corrosion resistance when used for a ballast tank. Each of the corrosion-resistant steels disclosed in the publication contains 0.15 to 0.50% Cu and 0.01 to less than 0.05% W as basic components and, in addition, 0.2% or less C, 1.0% or less Si, 1.5% or less Mn and 0.1% or less P and, as required, 0.05 to 1.0% Mo.

Japanese Unexamined Patent Publication No. S48-50922 proposes a steel containing Cu, W and one or more of Ge, Sn, Pb, As, Sb, Bi, Te and Be as a corrosion-resistant low-alloy steel on the basis that the steel exhibits excellent corrosion resistance, more specifically excellent resistance to local corrosion in a ballast tank. The corrosion-resistant steel disclosed in the publication contains 0.15 to 0.50% Cu, 0.05 to 0.5% W and one or more of Ge, Sn, Pb, As, Sb, Bi, Te and Be by a total of 0.01 to 0.2% as basic components and, in addition, 0.2% or less C, 1.0% or less Si, 1.5% or less Mn and 0.1% or less P and, as required, 0.01 to 1.0% Mo.

Japanese unexamined Patent Publication No. 549-3808 proposes a Cu—Mo steel as a corrosion-resistant low-alloy steel on the basis that the steel exhibits excellent corrosion resistance in a ballast tank, high strength and good weldability. The corrosion-resistant steel disclosed in the publication contains 0.05 to 0.5% Cu and 0.01 to 1% Mo as basic components and, in addition, 0.2% or less C, 1.0% or less Si, 0.3 to 3.0% Mn and 0.1% or less P.

Japanese unexamined Patent Publication No. S49-52117 proposes a Cr—Al steel as a seawater corrosion-resistant low-alloy steel on the basis that the steel is excellent in corrosion resistance in seawater, more specifically in resistance to pitting corrosion and crevice corrosion, which are likely to occur in quantity to a steel containing alloying elements. The corrosion-resistant steel disclosed in the publication contains 1 to 6% Cr and 0.1 to 8% Al as basic components and, in addition, 0.08% or less C, 0.75% or less Si, 1% or less Mn, 0.09% or less P and 0.09% or less S.

Japanese Unexamined Patent Publication No. H7-310141 proposes a Cr—Ti steel as a seawater corrosion-resistant steel for use in a high-temperature and high-humidity environment and a method for producing the same on the basis that the steel exhibits excellent resistance to seawater corrosion in a high-temperature and high-humidity environment of a marine vessel, namely in a ballast tank or in a seawater pipe and excellent toughness at a heat-affected zone (HAZ). The corrosion-resistant steel disclosed in the publication contains 0.50 to 3.50% Cr as a basic component and, in addition, 0.1% or less C, 0.50% or less Si, 1.50% or less Mn and 0.005 to 0.050% Al.

Japanese Unexamined Patent Publication No. H8-246048 proposes a Cr contained steel in a method for producing a seawater corrosion-resistant steel excellent in toughness of a HAZ for use in a high-temperature and high-humidity environment on the basis that the steel exhibits excellent resistance to seawater corrosion in a high-temperature and high-humidity environment of a marine vessel, namely in a ballast tank or a seawater pipe. The corrosion-resistant steel disclosed in the publication contains 1.0 to 3.0% Cr and 0.005 to 0.03% Ti as basic components and, in addition, 0.1% or less C, 0.10 to 0.80% Si, 1.50% or less Mn and 0.005 to 0.050% Al.

Here, problems of the conventional technologies described above are explained.

The problems arising when corrosion is mitigated by means of corrosion prevention coating such as primer coating, heavy-duty coating or metal spraying have been that: the application work entails substantial costs; and, in addition, corrosion develops to a extent comparable to a case of bare use in 5 to 10 years of normal use at the longest, because local corrosion inevitably occurs and propagates from microscopic defects in protective coating layers caused during the application work and other defects resulting from age-related degradation. Another problem has been that periodical inspections and repair are indispensable and maintenance costs are involved as a consequence. Yet another problem has been that, with regard to local corrosion at the floor plate of an oil tank, the rate of progress of local corrosion occurring after protective coating layers have been degraded is substantially the same as that occurring in bare use.

The problems of the steel for an oil loading pipe disclosed in Japanese Unexamined Patent Publication No. S50-158515 have been that: since it contains Cr, which is detrimental to corrosion resistance in a crude oil tank environment, in excess of 0.1%, the rate of progress of local corrosion at the floor plate of an oil tank is not reduced and the cost effect of corrosion resistance is insufficient to justify the total addition amount of the alloying elements; and the weldability of the steel is poor in comparison with an ordinary steel because it contains Cr.

The problems of the corrosion-resistant steel for shipbuilding disclosed in Japanese Unexamined Patent Publication No. 2000-17381 have been that: since it contains Mg as an indispensable element, the production of the steel is unstable; and, according to the studies by the present inventors, the rate of progress of local corrosion at the floor plate of an oil tank is not reduced by the use of a Cu—Mg steel and the cost effect of corrosion resistance is insufficient to justify the total addition amount of the alloying elements.

The problems of the corrosion-resistant steel for an oil loading tank (a high-P—Cu—Ni—Cr-high-Al steel) disclosed in Japanese Unexamined Patent Publication No. 2001-107179 have been that: since it contains Cr, which is detrimental to corrosion resistance in an environment of a crude oil tank floor plate, by 0.3 to 4% in excess of 0.1%, the rate of progress of local corrosion at the floor plate of an oil tank is not reduced and the cost effect of corrosion resistance is insufficient to justify the total addition amount of the alloying elements; and the weldability of the steel is poor in comparison with an ordinary steel because it contains Cr.

The problems of the corrosion-resistant steel for an oil loading tank (a low-P—Cu—Ni—Cr-high-Al steel) disclosed in Japanese unexamined Patent Publication No. 2001-107180 have been that: since it contains Cr, which is detrimental to corrosion resistance in an environment of a crude oil tank floor plate, by 0.3 to 4% in excess of 0.1%, the rate of progress of local corrosion at the floor plate of an oil tank is not reduced and the cost effect of corrosion resistance is insufficient to justify the total addition amount of the alloying elements; the weldability of the steel is poor in comparison with an ordinary steel because it contains Cr; and, although the publication maintains that the steel after application of a primer coating suppresses corrosion under a coating film in a gas phase to which the reverse side of a deck plate or the like of an oil tank is exposed, since the steel contains comparatively large amounts of Cr and Al, the rate of corrosion propagating in the thickness direction from defects in a coating film is not reduced despite the width of blisters occurring from defects in the coating film being reduced.

The problem of the corrosion-resistant steels (Cu—Ni steels) for oil loading tanks disclosed in Japanese Unexamined Patent Publication Nos. 2002-12940 and 2003-105467 has been that, though the publications maintain that Cu and Ni are effective in enhancing corrosion resistance, more specifically resistance to corrosion under a coating film, and Mo is detrimental to corrosion resistance but is effective for enhancing strength, since any of the Cu—Ni—Mo steels proposed as corrosion-resistant steels in the example contains Mo in excess of the upper limit (0.2%) of the present invention, the effect of suppressing the progress of local corrosion at the floor plate of a crude oil tank is not achieved.

The problems of the corrosion-resistant steels (a Cu contained steel, a Cr contained steel, an Mo contained steel, an Ni contained steel, an Sb-contained steel and an Sn-contained steel) for crude oil or heavy oil storage tanks disclosed in Japanese Unexamined Patent Publication No. 2001-214236 have been that: large amounts of alloying elements must be added in order to obtain excellent corrosion resistance as the example shows that it is indispensable to add one or more of 0.22 to 1.2% Cu, 0.3 to 5.6% Cr, 0.5 to 6.2% Ni, 0.25 to 7.56% Mo, 0.07 to 0.25% Sb and 0.07 to 1.5% Sn; and thus the economical efficiency and weldability of the proposed steels are poor.

The problems of the corrosion-resistant steel for a tank for transporting or storing crude oil (a Cu—Ni—Cr steel) disclosed in Japanese Unexamined Patent Publication No. 2002-173736 have been that: the steel contains 0.5 to 1.5% Cu, 0.5 to 3.0% Ni and 0.5 to 2.0% Cr as basic components, thus large amounts of alloying elements must be added for the effect to appear; thus the economical efficiency and weldability of the proposed steels are poor; and further, since the steel contains Cr, which is detrimental to corrosion resistance in an environment of a crude oil tank floor plate, in excess of 0.1%, the rate of progress of local corrosion at the floor plate of an oil tank is not reduced and the cost effect of corrosion resistance is insufficient to justify the total addition amount of the alloying elements.

With regard to the steels for cargo oil tanks (Ni contained steels and Cu—Ni steels) disclosed in Japanese Unexamined Patent Publication No. 2003-82435, steel components are studied which decrease the progress of local corrosion in an experimental corrosive environment simulating not that at the floor plate of an oil tank, but at the reverse side of a deck plate. Table 4 of the publication lists the following as the steels that contain Cu, Ni and Mo as basic components but not Cr: sample nos. B4 (0.43% Cu-0.18% Ni-0.26% Mo), B6 (0.33% Cu-0.31% Ni-0.35% Mo), B13 (0.38% Cu-0.12% Ni-0.44% Mo), B15 (0-35% Cu-0.28% Ni-0.31% Mo), B19 (0.59% Cu-0.16% Ni-0.22% Mo) and B20 (0.59% Cu-0.44% Ni-0.22% Mo). The problems of the steels have been that: all of these steels requires relatively large addition amounts of alloying components even though only the basic components are taken into consideration and results in unfavorable costs and weldability; and further, in order to realize excellent corrosion resistance in an environment of a crude oil tank floor plate, it is necessary to use an Ni-contained steel or a Cu—Ni steel, control the number of inclusions larger than 30 μm in grain size to less than 30/cm$^2$, and control the pearlite ratio Ap in the metallographic structure and the carbon content in the steel so as to satisfy the expression $Ap/C \leqq 130$.

Next, the problems of the corrosion-resistant steels proposed for the use in the ballast tank of a marine vessel are explained.

The problems of the corrosion-resistant low-alloy steels (a Cu—W steel and a Cu—W—Mo steel) disclosed in Japanese Examined Patent Publication No. S49-27709 have been that: since the steels do not contain Al according to the chemical compositions of the invention steels shown in Table 1 of the examples described in patent document 10, resistance to local corrosion is not secured in the case of the floor plate of a crude oil tank; and further the proposed steel, which is not Al-killed steels, is hardly applicable to the latest shipbuilding use from the viewpoints of the cleanliness of the steels and the toughness of welds.

The problems of the corrosion-resistant low-alloy steels (a Cu—W steel and a Cu—W—Mo steel) disclosed in Japanese Unexamined Patent Publication No. S48-50921 have been that: since the steels do not contain Al according to the chemical compositions of the invention steels shown in Table 1 of the examples described in the patent, resistance to local corrosion is not secured in the case of the floor plate of a crude oil tank; and further the proposed steel, which is obviously not Al-killed steels, is hardly applicable to the latest shipbuilding use from the viewpoints of the cleanliness of the steels and the toughness of welds.

The problems of the corrosion-resistant low-alloy steel disclosed in Japanese Unexamined Patent Publication No. S48-50922 have been that: since the steel contains 0.15 to 0.50% Cu, 0.05 to 0.5% W and further one or more of Ge, Sn, Pb, As, Sb, Bi, Te and Be by 0.01 to 0.2%, the proposed steel is markedly poor in hot workability; since the steel does not contain Al according to the chemical compositions shown in Table 1 of the patent, local corrosion resistance is not secured in the case of a floor plate of a crude oil tank; and further the proposed steel, which is obviously not an Al-killed steel, is hardly applicable to the latest shipbuilding use from the viewpoints of the cleanliness of the steel and the toughness of a weld.

The problems of the Cu—Mo steel proposed in Japanese Unexamined Patent Publication No. 549-3808 as a corrosion-resistant low-alloy steel for ballast tank use is that: since the steel is obviously required to contain not less than 0.008% S in order to obtain desired corrosion resistance in a ballast tank environment according to the chemical composition of the proposed steel shown in the examples described in the patent, the proposed steel cannot secure local corrosion resistance comparable with that of a steel according to the present invention in the case of a crude oil tank floor plate; since the steel does not contain Al, local corrosion resistance is not secured in the case of a floor plate of a crude oil tank; and further the proposed steel, which is obviously not an Al-killed steel, is hardly applicable to the latest shipbuilding use from the viewpoints of the cleanliness of the steel and the toughness of a weld.

The problem of the corrosion-resistant steels disclosed in Japanese Unexamined Patent Publication Nos. S49-52117, H7-310141 and H8-246048 has been that each of the steels contains not less than 0.5% Cr as a basic component and cannot secure local corrosion resistance in the case of the floor plate of a crude oil tank.

Other than the conventional technologies mentioned above, some technologies regarding low-alloy corrosion-resistant steels for other applications have been disclosed. Some comments are given thereon hereafter.

Automobile undercarriage members suffer wet corrosion involving chloride ions with deicing salt attaching thereto. With regard to low-alloy steels for automobile undercarriage members excellent in pitting corrosion resistance that cope with such corrosion problem, there are, for instance: the technology characterized by adding Cu, Ni, Ti and P to a steel and, by so doing, forming a protective film composed of phosphate on the surface of the steel (such as the one disclosed in Japanese Unexamined Patent Publication No. S62-243738); and the technology characterized by adding P and/or Cu to a steel and, by so doing, making the formed rust layer amorphous and dense so as to enhance the protective capability of the rust layer (such as the one disclosed in Japanese Unexamined Patent Publication No. H2-22416). In addition, many steelmakers have developed and commercialized seawater-resistant low-alloy steels having improved seawater resistance (cf. "Corrosion-resistant Low-alloy Steel" by Iwao Matsushima, p. 117, published from Chijin Shokan in 1995).

In the case of those steels for automobile undercarriage parts excellent in pitting corrosion resistance and other weatherproof steels, although it is true that a protective dense rust layer forms on the surface even when such a steel is used in a salt damage environment, such excellent pitting corrosion resistance is obtained only in an environment where wet and dry are repeated properly and resultantly a protective dense rust layer forms spontaneously and not in an environment where the steel surface is always wet. Thus, such excellent pitting corrosion resistance is not obtained in an environment where the time of wetting is long or the steel surface is always wet. On the other hand, in the case of the seawater-resistant low-alloy steels mentioned above, though they often exhibit better performance than ordinary steels regarding the kind of corrosion resistance to be evaluated in terms of an average thickness loss rate, they are not viewed as distinctly superior to ordinary steels regarding a local corrosion rate of progress (cf. "Corrosion-resistant Low-alloy Steel" by Iwao Matsushima, p. 112, published from Chijin Shokan in 1995).

As has hitherto been explained, in the application of a steel to a welded structure such as a crude oil tank, development of a low-alloy steel having a low local corrosion progress rate even though general corrosion may occur has been looked for from the viewpoints of enhancing the reliability of a structure and extending the service life. As for the technologies for decreasing the progress of local corrosion at the floor plate of a crude oil tank, merely the methods of applying a protective lining to the floor plate have been proposed. There have been a number of proposals regarding corrosion-resistant steels to mitigate the corrosion occurring in the environment of a ballast tank, which is similar to the environment of a crude oil tank intended in the present invention, or in the environment at the reverse side of a deck plate of a crude oil tank. However, there has been only one proposal regarding a corrosion-resistant steel having a low local corrosion progress rate at the floor plate of a crude oil tank, which is the invention disclosed in the Japanese Unexamined Patent Publication No. 2003-82435 mentioned earlier.

2) Measures to Reduce the Amount of Solid Sulfur That Precipitates on the Surfaces of Steel Plates in a Gas Phase and Causes Sludge to Form and Problems of Conventional Technologies Corrosion prevention by painting and lining has commonly been employed as a technique to protect steel from corrosion and, at the same time, reduce sludge composed mainly of solid sulfur. Corrosion prevention by spraying zinc and/or aluminum has also been proposed (cf. Recommended Practice of Corrosion Control and Protection in Aboveground Oil Storage Tank HPIS G, p. 18 (1989-90), of the High Pressure Institute of Japan). However, like in the case of corrosion reduction measures, the problems of the technologies have been that: the application work entails economic costs; and, in addition, since corrosion inevitably progresses as a result of microscopic defects in protective layers caused during the application work and age-related degradation, periodical inspections and repair are indispensable and the service life is limited to 5 to 10 years, even when painting and lining are applied.

Despite the above problems, there has been disclosed no technology to decrease the precipitation of solid sulfur on a steel surface by improving the corrosion resistance of steel itself in a crude oil tank environment. In such a situation, in the application of a steel to a welded structure such as an oil tank, development of a steel for a welded structure excellent in corrosion resistance and capable of decreasing the formation of sludge mainly composed of solid sulfur has been looked for from the viewpoints of enhancing the reliability of the structure and extending the service life.

DISCLOSURE OF THE INVENTION

The object of the present invention, which has been established to solve the above problems, is to provide: a steel for a welded structure to be used for a crude oil tank, the steel exhibiting excellent local corrosion resistance in an environment of the floor plate of a crude oil tank and decreasing the rate of formation of a corrosion product containing solid sulfur in a gas phase at the reverse side of the upper deck plate of a crude oil tank; a method for producing the steel; a crude oil tank; and a method for protecting the crude oil tank against corrosion.

The present inventors, in an attempt to solve the aforementioned problems, investigated the influences of chemical components, metallographic structures and production methods on the behavior of progress of local corrosion at the floor plate of a crude oil tank and the behavior of precipitation of solid sulfur at the reverse side of an upper deck plate, and as a result made the following discoveries:

[1] Means to Suppress the Progress of Local Corrosion at the Floor Plate of a Crude Oil Tank A great amount of rock salt brine is contained in crude oil and it separates from the oil and remains on the floor plate of a crude oil tank. The present inventors found, first, that the concentration of such rock salt brine, which varied in accordance with the oil field and the depth of an oil well from which the crude oil came, was as high as roughly 1 to 60 mass % in terms of an NaCl-reduced concentration. They also found out that, when a steel plate was exposed to such high-concentration brine, or a high-concentration aqueous solution of halogen, the following occurred: the condition at the surface of the steel plate became uneven by sediment of corrosion products, sludge, ash and the like; the sites where the base steel dissolved selectively were quickly formed and fixed; and local corrosion developed from these sites. Further, on the basis of the above discoveries, the present inventors proposed the following corrosion mechanism: the pH buffering capacity of the high-concentration brine was so small that the value of pH rapidly fell to 2 or lower at the sites where the base steel dissolved selectively as a consequence to the hydrolysis of dissolved ions of iron and alloying elements, and local corrosion developed from those sites in a catalytically accelerated manner.

Further, the present inventors studied the influences of Cu and Mo on the rate of progress of local corrosion using Fe—Cu—Mo steels, which contained various addition amounts of Cu (0.1 to 0.5 mass %) and Mo (0.025 to 0.075 mass %), produced in a laboratory and, as a result, made the findings set out below.

FIG. 1 shows the influence of an addition amount of Mo on the rate of progress of local corrosion of Fe—Cu—Mo steels. The present inventors found from the figure that the rate of progress of local corrosion fell to minimum when the Mo content was roughly 0.05 mass % and the local corrosion reduction effect of Mo decreased when its content was 0.1 mass % or more. As a consequence, it became clear that the most desirable Mo addition amount was in the range from 0.03 to 0.07%.

FIG. 2 shows the influence of an addition amount of Cu on the rate of progress of local corrosion of Fe—Cu—Mo steels. The present inventors found from the figure that the remarkable effect of combined Cu—Mo addition on suppressing the rate of progress of local corrosion was observed when the Cu amount was not less than 0.1 mass %, and the effect became substantially saturated when the Cu amount reached 0.3%.

FIGS. 3(*a*) and (*b*) show the influences of the contents of P and S, respectively, on the rate of progress of local corrosion of 0.3% Cu-0.05% Mo steels. Either of P and S, which were impurity elements, tended to accelerate the progress of local corrosion: the rate of progress of local corrosion increased significantly when the P content exceeded 0.03% or the S content exceeded 0.02%. It was also clear that the detrimental effects of these elements could be minimized when the P content was not more than 0.010% or the S content was not more than 0.0070%.

FIG. 4 shows the influence of an addition amount of Al on the rate of progress of local corrosion of Low-P-low-S—Cu—Mo steels. The rate of progress of local corrosion followed a downward convex curve, and it increased when the Al content exceeded 0.3%. Further, it was clear that local corrosion resistance was enhanced yet more when the Al content was controlled to 0.01 to 0.1%.

The above findings can be summarized as follows:

① When 0.01 to 0.1 mass % Mo is added to a steel containing not less than 0.1 mass % Cu, the rate of progress of local corrosion is remarkably decreased to not more than ⅕ that of an ordinary steel.

② When more than 0.1 mass % Mo is added to a steel containing not less than 0.1 mass % Cu, the effect of Mo on suppressing the rate of progress of local corrosion decreases.

③ In the case of a steel containing not less than 0.1 mass % Cu, the most suitable addition amount of Mo is in the range from 0.03 to 0.07 mass %.

④ An excessive addition of either P or S accelerates the rate of progress of local corrosion, and excellent local corrosion resistance is obtained by setting the upper limits of the contents of P and S.

⑤ when the addition amount of Al is controlled to 0.01 to 0.1%, local corrosion resistance is enhanced yet further.

⑥ Cr is a harmful element that accelerates the progress of local corrosion significantly, and it is desirable to control its content to 0.01% or less.

A feature of the present invention is to decrease the rate of progress of local corrosion at corroded portions after the formation of local corrosion, on the basis of the above and other findings by the present inventors.

Further, the present inventors further investigated and, as a result, made the findings set out below.

Specifically, the following results were obtained, on the basis of the chemical composition of a common steel for a welded structure, substantially not adding Cr, by adding specific amount(s) of Mo and/or W in combination with Cu, limiting the addition amounts of P and S, which are impurity elements, and adding Al:

1) when contents of P, S, and Al are controlled to respectively defined ranges, the rate of progress of the local corrosion in the environment in question decreases remarkably with the smaller addition amounts of alloying elements of Cu, Mo and W; and 2) according to the results of detailed studies on the relationship between the state of Mo and W in a steel and corrosion resistance, when Mo and W exist in a steel in the state of solid solution, their effects in enhancing corrosion resistance are further increased.

[2] Means to Reduce Solid Sulfur That Precipitates From a Gas Phase on the Reverse Side of the Upper Deck Plate of a Crude Oil Tank and Causes Sludge to Form As a result of extensive study of the precipitation behavior of solid sulfur from a gas phase on the surface of a steel plate used as the upper deck plate of a crude oil tank, the present inventors made the following findings: ① solid sulfur precipitates as a result of a reaction of hydrogen sulfide and oxygen in a gas phase in a crude oil tank with iron rust on the surface working as a catalyst; ② the precipitation rate of the solid sulfur depends on the temperature, the concentrations of hydrogen sulfide and oxygen in the gas phase and, further, on alloying elements included in the iron rust in minimal quantities; ③ when both Cu and Mo are included in the iron rust, the precipitation rate of the solid sulfur decreases; and ④ when both Cu and Mo are included in the iron rust, the rate of progress of general corrosion in the environment in question also decreases. On the basis of the above findings, the present inventors discovered that it was possible to enhance corrosion resistance, or resistance to general corrosion, in the environment in question by not adding Cr, adding Cu and Mo in combination by respectively defined amounts and limiting the addition amounts of P and S, which are impurity elements, on the basis of the chemical composition of a common steel for a welded structure.

The gist of the present invention, which has been established-based mainly on the above findings, is as follows:

(1) A steel for a crude oil tank characterized by containing, in mass, 0.001 to 0.2% C, 0.01 to 2.5% Si, 0.1 to 2% Mn, 0.03% or less P, 0.007% or less S, 0.01 to 1.5% Cu, 0.001 to 0.3% Al, 0.001 to 0.01% N and one or both of 0.01 to 0.2% Mo and 0.01 to 0.5% W, with the balance consisting of Fe and unavoidable impurities.

(2) A steel for a crude oil tank according to the item (1), characterized by satisfying the following expression, in mass %;

$$\text{Solute Mo}+\text{Solute W} \geqq 0.005\%.$$

(3) A steel for a crude oil tank according to the item (1) or (2), characterized in that the carbon equivalent (Ceq.), in mass %, defined by the equation (1) is 0.4% or less;

$$\text{Ceq.}=C+Mn/6+(Cu+Ni)/15+(Cr+Mo+W+V)/5 \quad (1).$$

(4) A steel for a crude oil tank according to any one of the items (1) to (3), characterized in that the Cr content is less than 0.1 mass %.

(5) A steel for a crude oil tank according to any one of the items (1) to (4), characterized by further containing, in mass, 0.1 to 3% Ni and/or 0.1 to 3% Co.

(6) A steel for a crude oil tank according to any one of the items (1) to (5), characterized by further containing, in mass, one or more of 0.01 to 0.3% Sb, 0.01 to 0.3% Sn, 0.01 to 0.3% Pb, 0.01 to 0.3% As and 0.01 to 0.3% Bi.

(7) A steel for a crude oil tank according to any one of the items (1) to (6), characterized by further containing, in mass, one or more of 0.002 to 0.2% Nb, 0.005 to 0.5% V, 0.002 to 0.2% Ti, 0.005 to 0.5% Ta, 0.005 to 0.5% Zr and 0.0002 to 0.005% B.

(8) A steel for a crude oil tank according to any one of the items (1) to (7), characterized by further containing, in mass, one or more of 0.0001 to 0.01% Mg, 0.0005 to 0.01% Ca, 0.0001 to 0.1% Y, 0.005 to 0.1% La and 0.005 to 0.1% Ce.

(9) A steel for a crude oil tank according to any one of the items (1) to (8), characterized in that the area percentage of microscopic segregation portions where the Mn concentration is 1.2 times or more the average Mn concentration in the steel is 10% or less.

(10) A method for producing a steel for a crude oil tank according to any one of the items (1) to (9), characterized in that, in the event of applying accelerated cooling after hot rolling a slab containing components according to any one of the items (1) to (8), the average cooling rate of the accelerated cooling is in the range from 5 to 100° C./sec., the accelerated cooling end temperature is in the range from 600° C. to 300° C., and the cooling rate in the temperature range from the accelerated cooling end temperature to 100° C. is in the range from 0.1 to 4° C./sec.

(11) A method for producing a steel for a crude oil tank, characterized by applying tempering or annealing at 500° C. or lower to a steel produced by the method according to the item (10).

(12) A method for producing a steel for a crude oil tank according to any one of the items (1) to (9), characterized in that, in the event of applying normalizing after hot rolling a slab containing components according to any one of the items (1) to (8), the heating temperature of the normalizing is in the range from the $Ac_3$ transformation temperature to 1,000° C. and the average cooling rate in the temperature range from 700° C. to 300° C. is in the range from 0.5 to 4° C./sec.

(13) A method for producing a steel for a crude oil tank characterized by applying tempering or annealing at 500° C. or lower to a steel normalized according to the item (12).

(14) A method for producing a steel for a crude oil tank according to any one of the items (10) to (13), characterized by, before hot rolling a slab containing components according to any one of the items (1) to (8), applying diffusion heat treatment to the slab at a heating temperature of 1,200 to 1,350° C. and for a retention time of 2 to 100 hr.

(15) A crude oil tank characterized in that the floor plate, deck plate, side walls and structural members thereof are made wholly or partially of a steel for a crude oil tank according to any one of the items (1) to (9).

(16) A method for protecting a crude oil tank against corrosion characterized by removing, either mechanically or chemically, hot-rolling scale on the surface of a crude oil tank according to the item (15) and exposing the base steel substrate.

(17) A method for protecting a crude oil tank against corrosion according to the item (16), characterized by forming one or more layers of a coating film 10 μm or more in thickness on the surface after hot-rolling scale is removed mechanically or chemically.

BRIEF DESCRIPTION OF THE DRAWINGS

FIG. 3(*b*) is a graph showing the relationship between a local corrosion rate of progress and the S content of Fe—Cu—Mo steels.

BEST MODE FOR CARRYING OUT THE INVENTION

Figure 1:
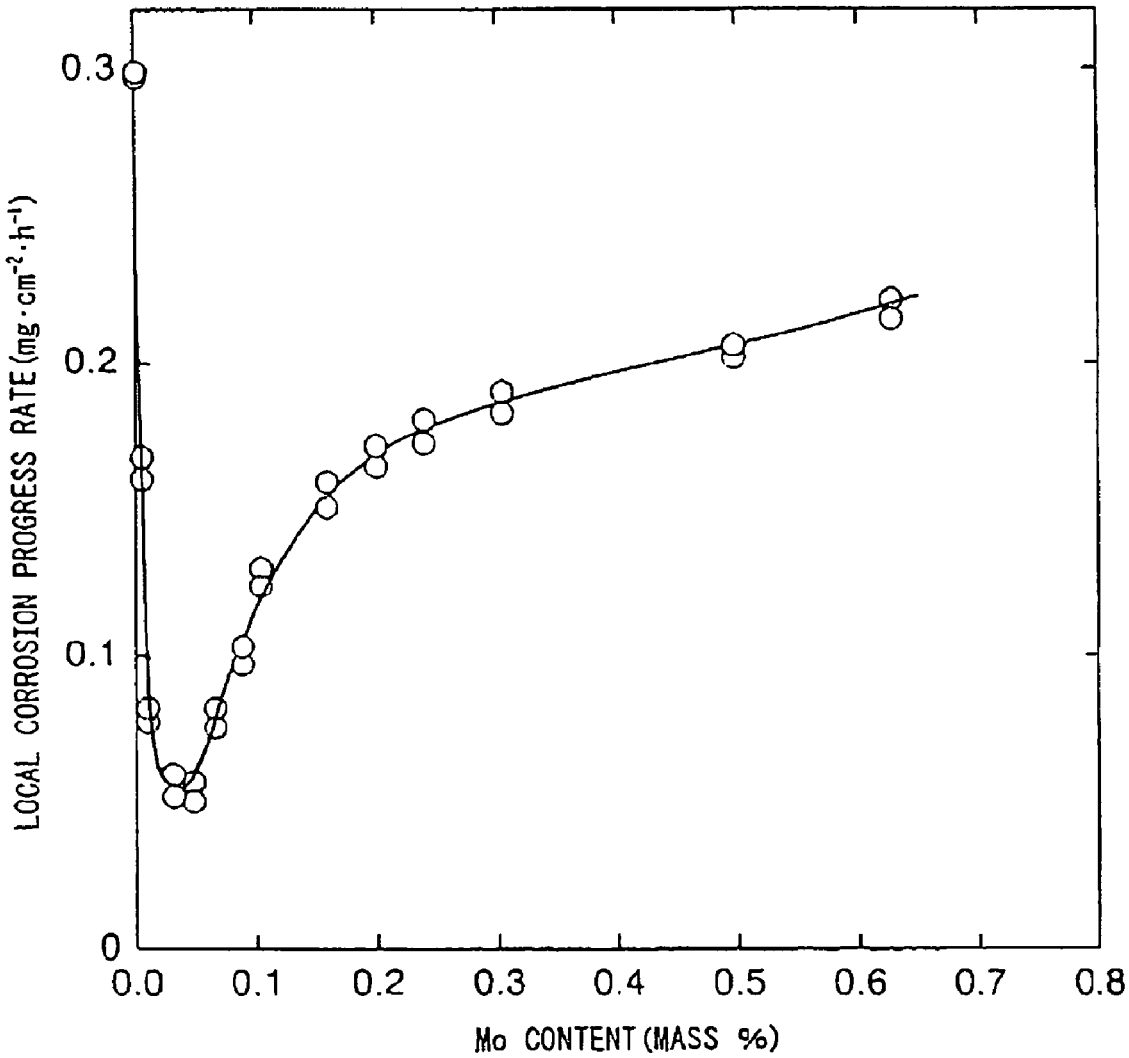
FIG. 1 is a graph showing the relationship between a local corrosion rate of progress and the Mo content of Fe—Cu—Mo steels.
Figure 2:
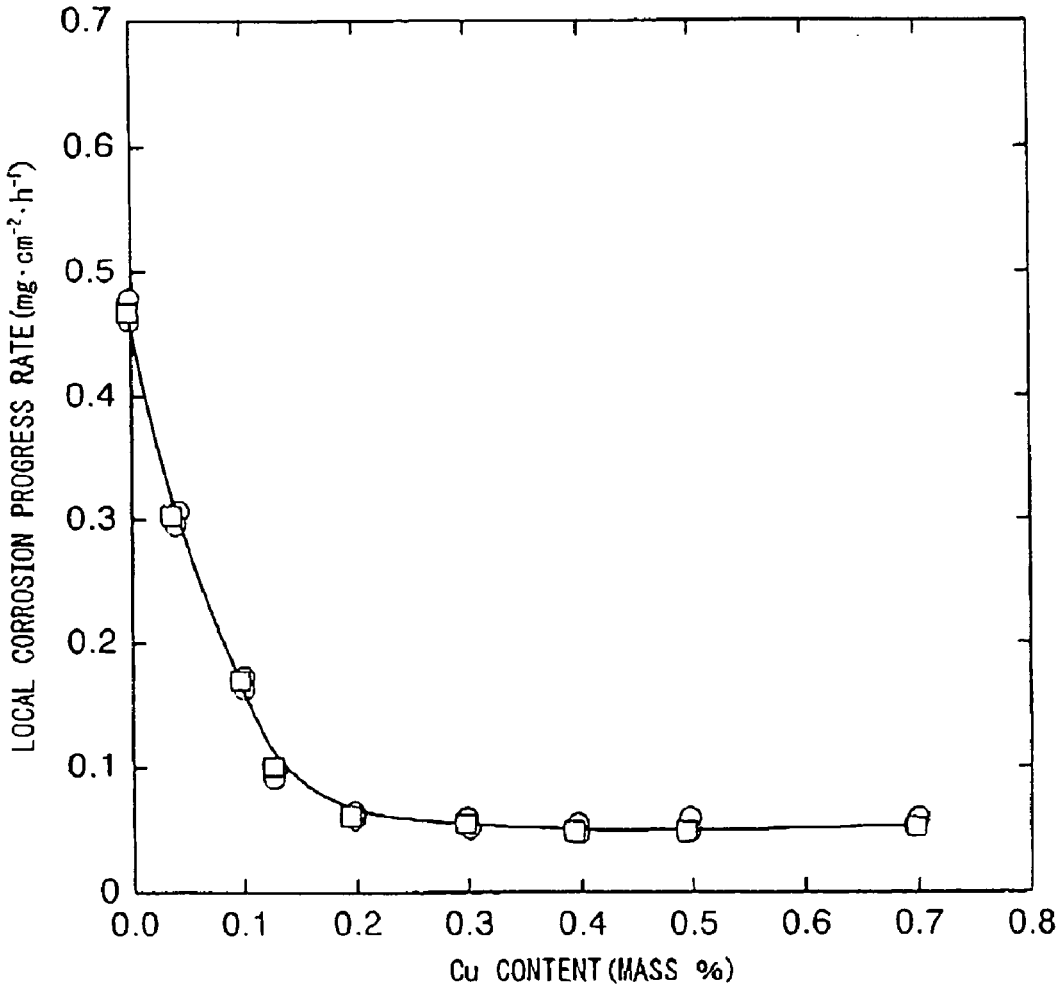
FIG. 2 is a graph showing the relationship between a local corrosion rate of progress and the Cu content of Fe—Cu—Mo steels.
Figure 3A:
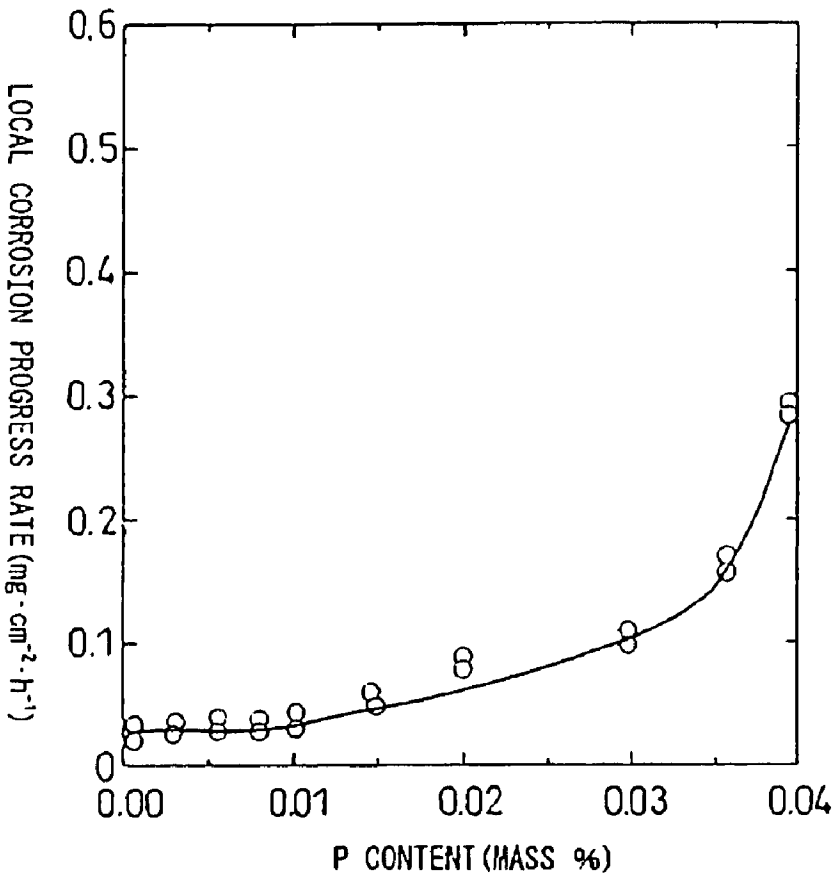
FIG. 3(*a*) is a graph showing the relationship between a local corrosion rate of progress and the P content of Fe—Cu—Mo steels.
Figure 3B:
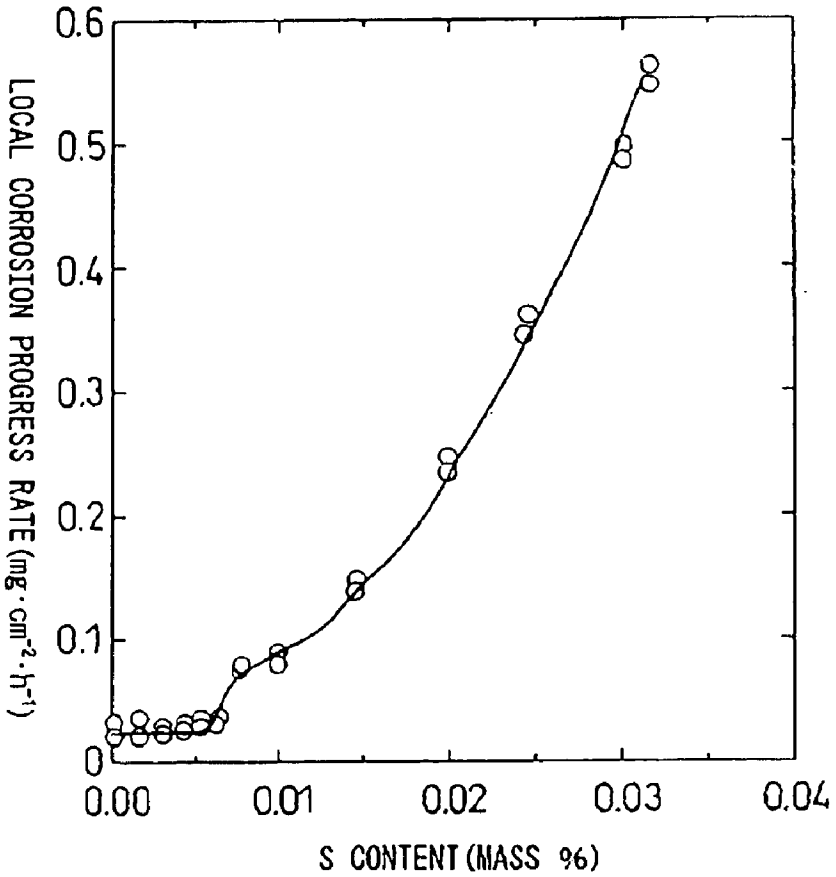

The measures to be taken so as to overcome the aforementioned problems and attaining the object of the present invention are hereafter explained concretely.

Firstly, the component elements of a steel according to the present invention and their contents are explained. The contents of the component elements are indicated herein in terms of mass %. C is to be contained by 0.001% or more because it is industrially very uneconomical to decarbonize a steel to a carbon content of less than 0.001%. However, when C is used as a strengthening element, it is desirable to control its content to 0.002% or more. On the other hand, when C is contained in excess of 0.2%, weldability, the toughness of weld joints and other properties deteriorate to degrees unsuitable for a steel used for a welded structure. For this reason, the C content is limited in the range from 0.001 to 0.2%. It is more desirable for the C content to be 0.18% or less from the viewpoint of welding operability. A C content in the range from 0.05 to 0.15% is yet more desirable, especially for mild steels for marine vessels (of a yield stress of 240 $N/mm^2$ class), high-tensile steels (of a yield stress of 265, 315, 355, or 390 $N/mm^2$ class) and high-tensile steels for marine vessels. Since C is an element that somewhat lowers the local corrosion resistance of the floor plate of a crude oil tank, a C content desirable from the viewpoint of corrosion resistance is 0.15% or less.

Si is indispensable as a deoxidizing element, and its content must be 0.01% or more so as to obtain a sufficient deoxidizing effect. Si is an element effective in improving resistance to general corrosion and also for enhancing, though only slightly, resistance to local corrosion. In order to secure these effects, it is desirable to add Si by 0.1% or more. On the other hand, when Si is added excessively, hot-rolling scale becomes adhesive (scale exfoliates) and defects caused by hot-rolling scale increase. For this reason, the upper limit of Si content is set at 2.5% in the present invention. In particular, when a steel is required to have higher weldability and toughness of base material and weld joint in addition to corrosion resistance, it is desirable to set the upper limit at 0.5%.

0.1% or more Mn is required for securing steel strength. However, an Mn content exceeding 2% is unacceptable, because weldability deteriorates and sensitivity to intergranular brittleness is increased. For this reason, the Mn content is limited in the range from 0.1 to 2% in the present invention. It should be noted that since C and Mn are elements having little influence on corrosion resistance, it is possible to adjust the carbon equivalent by properly adjusting the content(s) of C and/or Mn when the carbon equivalent has to be controlled within a certain range, especially for welded structure use.

P is an impurity element, and when its content is more than 0.03%, the local corrosion rate of progress increases and weldability deteriorates. For this reason, the P content is limited to 0.03% or less. When the P content is 0.0153 or less, good effects are obtained, especially in corrosion resistance and weldability and for this reason, it is desirable to control the P content to 0.015% or less. It is more desirable to control the P content to 0.005% or less, because by so doing, corrosion resistance is further improved, although production costs increase.

S is also an impurity element, and when its content is more than 0.007%, the local corrosion rate of progress increases, the amount of sludge formed tends to increase, and mechanical properties, particularly ductility, deteriorate remarkably.

For these reasons, the upper limit of S content is set at 0.007%. The smaller the S content, the better the corrosion resistance and mechanical properties. Therefore, it is more desirable to control the S content to 0.005% or less.

Cu is effective in improving resistance to general corrosion as well as to local corrosion when it is added by 0.01% or more in combination with Mo and W. Further, Cu is effective in decreasing the formation of solid sulfur when it is added by 0.03% or more. However, adverse effects such as increase in slab surface cracking and deterioration of the toughness of a weld joint become apparent when the Cu content is more than 1.5%. For this reason, the upper limit of a Cu content is set at 1.5% in the present invention. When Cu is added in excess of 0.5%, the enhancement of corrosion resistance becomes virtually saturated. Therefore, when it is intended to decrease the progress of local corrosion of the floor plate of a crude oil tank, a desirable Cu content is in the range from 0.01 to 0.5%. When Cu is added by 0.2% or more, its effect of decreasing the formation of sludge becomes virtually saturated. Therefore, when a steel is used for the upper deck of a crude oil tank, a preferable cu content is in the range from 0.03 to less than 0.2% in consideration of operability.

Al is an element indispensable for suppressing the progress of local corrosion when it is added together with Cu and Mo and/or W. Also, Al forms AlN and is an element effective in fractionizing austenite crystal grains by AlN in the heating of a base material. Further, Al is a useful element, since it has the effect of suppressing the formation of a corrosion product containing solid sulfur. In order to secure these effects, an Al content of 0.001% or more is necessary. On the other hand, when Al is contained in excess of 0.3%, coarse oxide forms, deteriorate ductility and toughness. For this reason, the Al content has to be limited in the range from 0.001 to 0.3%. It is more desirable to add Al by 0.02% or more so as to obtain sufficient effects of enhancing corrosion resistance and decreasing the formation of a corrosion product containing solid sulfur. The corrosion resistance improvement effect of Al is virtually saturated when it is added in excess of 0.1%, and thus a more desirable Al content range is from 0.02 to 0.10%.

N is undesirable because it adversely affects ductility and toughness when it exists in a solid solution state. However, because N is effective in fractionizing austenite grains and enhancing precipitation strengthening when it combines with V, Al and Ti, it is effective in enhancing mechanical properties as long as its content is small. It is industrially impossible to completely remove N from a steel and therefore the reduction of N exceeding a necessary limit undesirably imposes excessive burdens on production processes. For this reason, the lower limit of N content is set at 0.001% as a level that allows adverse effects on ductility and toughness, industrial control and burdens on production processes. N has an effect of improving corrosion resistance somewhat. However, when N is contained excessively, solute N increases and ductility and toughness are likely to deteriorate. For this reason, the upper limit of N content is set at 0.01% as a tolerable level.

Mo and W are useful elements in local corrosion resistance, like Cu. When they are added in combination with 0.01% or more Cu, the effect of decreasing a local corrosion rate of progress is conspicuous. Mo and W show substantially the same effects. It is necessary to add Mo by 0.01 to 0.2% and/or W by 0.01 to 0.5%. When Mo or W is added by 0.01% or more, the effect of improving local corrosion resistance is conspicuous. On the other hand, when Mo is added by more than 0.2% or W by more than 0.5%, local corrosion resistance deteriorates rather than improve, and weldability and toughness also deteriorate. For this reason, the Mo content and W content are limited in the ranges from 0.01 to 0.2% and from 0.01 to 0.54, respectively. It should be noted that, in order to suppress the formation of precipitates and steadily secure the amounts of Mo and W in solid solution, it is more desirable to set the upper limits of the contents of Mo and W at lower than 0.1 and 0.05%, respectively. Further, a more desirable range of Mo addition is from 0.01 to 0.08%, because a remarkable improvement in local corrosion resistance is realized with a smaller amount of addition. A yet better range of Mo addition is from 0.03 to 0.07% in consideration of production stability. With respect to W, a more desirable range of addition amount is from 0.01 to less than 0.05%, because a remarkable improvement in local corrosion resistance is realized with a smaller amount of addition.

While the aforementioned ranges of Mo and W contents are essential requirements, in order to achieve the effect of improving local corrosion resistance more efficiently, it is necessary to secure more than a certain amount of Mo and W in solid solution while their contents are maintained within the above-required ranges. This is because, when either Mo or W forms coarse precipitates, portions depleted of the element are formed around the precipitates and the effect of improving local corrosion resistance is impaired. For this reason, it is necessary that either Mo or W be distributed in a steel as uniformly as possible. Solute Mo and W have substantially identical effects on local corrosion resistance, and as long as the total amount of both the elements in solid solution is 0.005% or more, local corrosion resistance is greatly improved. It is not necessary to specify an upper limit of the total amount of the solute Mo and W for obtaining the effects of the present invention. On the other hand, a steel is strengthened by solid solution, and in order to obtain an adequate strength economically, it is desirable to set the upper limit of the total amount of both the elements in solid solution at 0.5% or less.

Here, the total amount of Mo and W in solid solution cited in the present invention as effective for improving local corrosion resistance is defined by a value obtained by subtracting the amount of precipitates obtained through extraction residue analysis from the total content of the elements. This is because very fine precipitates that are regarded as being solute by extraction residue analysis can be viewed as being uniformly distributed in a steel like solute elements, and they work positively to improve corrosion resistance.

The fundamental requirements regarding the chemical composition of a steel according to the present invention and the reasons for defining them are described above. The present invention further specifies the conditions of elements that may be added to a steel optionally with the aim of improving various steel properties.

First, when it is necessary to give special consideration to weldability and the toughness of a weld joint, a carbon equivalent (Ceq.) defined by the equation (1) is controlled to 0.4% or less;

$$Ceq.=C+Mn/6+(Cu+Ni)/15+(Cr+Mo+W+V)/5 \quad (1).$$

The equation (1) is a carbon equivalent formula including W, which is an important element in the present invention. When a carbon equivalent according to the equation (1) is 0.4% or less, the hardening of a weld heat-affected zone (HAZ) is inhibited and resistance to low-temperature cracking and the toughness of HAZ are surely improved. For this reason, it is desirable to control the carbon equivalent to 0.4% or less. When the carbon equivalent is too large in excess of 0.4%, resistance to low-temperature cracking and the toughness of a HAZ, or even the stress corrosion cracking of a HAZ, may deteriorate in some combination of components. It is not necessary to specify a lower limit of carbon equivalent for obtaining the effects of the present invention. However, it is preferable to set the lower limit at 0.36% in order to obtain excellent toughness in the low temperature range from 0 to −40° C.

Cr is a strengthening element and it may be added for adjusting steel strength as required. However, Cr is the element that most increases the local corrosion rate of progress and thus should be as low as possible. When the Cr content is 0.1% or more, local corrosion resistance in a crude oil environment deteriorates and the formation of solid sulfur is accelerated to some extent. Therefore, a Cr content of 0.1% or more is not desirable in the present invention. As a conclusion, it is desirable not to add Cr intentionally or, if it is added either unavoidably or intentionally, to control the Cr content to less than 0.1%.

Ni and Co are elements effective in enhancing the toughness of a base material and a HAZ. They are effective also in improving corrosion resistance and suppressing sludge formation in a steel containing Cu and Mo. Either Ni or Co begins to exhibit tangible effects of improving toughness and corrosion resistance only when added by 0.1% or more. On the other hand, an excessive addition of either of them exceeding 3% is uneconomical because of its high price and causes weldability to deteriorate. For this reason, when Ni and/or Co are/is added, the content of each of them is limited in the range from 0.1 to 3% in the present invention.

When any one of Sb, Sn, As, Bi and Pb is added by 0.01% or more, the progress of local corrosion is further suppressed. For this reason, they may be added as required. In this case, the lower limit of content of each of them is set at 0.01%. However, when any of them is added in excess of 0.3%, the above effect is saturated and other steel properties may deteriorate. For this reason and in consideration also of economical efficiency, the upper limit of a content of each of the above elements is set at 0.3%. A more desirable content range is from 0.01 to 0.15% each.

Nb, V, Ti, Ta, Zr and B are elements effective in strengthening steel with a small addition amount and, as such, any of them may be added as required, principally for adjusting steel strength. In order for each element to obtain a tangible effect, the contents of each should be: 0.002% or more for Nb; 0.005% or more for V; 0.002% or more for Ti; 0.005% or more for Ta; 0.005% or more for Zr; or 0.0002% or more for B. On the other hand, when more than 0.2% Nb, more than 0.5% V, more than 0.2% Ti, more than 0.5% Ta, more than 0.5% Zr or more than 0.005% B is added, adversely, toughness is markedly lowered. For this reason, when any of these elements is added as required, each of the contents is limited in the ranges: from 0.002 to 0.2% for Nb; from 0-005 to 0.5% for V; from 0.002 to 0.2% for Ti; from 0.005 to 0.5% for Ta; from 0.005 to 0.5% for Zr; or from 0.0002 to 0.005% for B.

Mg, Ca, Y, La and Ce are effective in controlling the shape of inclusions and enhancing ductility and the HAZ toughness of a large-heat-input weld joint. They have also an effect of stabilizing S and thus suppressing the formation of sludge, though this is only slight. For this reason, they are added as required. The lower limits of the contents of those elements are defined in the present invention on the basis of the smallest contents with which a tangible effect is obtained, and the lower limits are as follows: 0.0001% for Mg; 0.0005% for Ca; 0.0001% for Y; 0.005% for La; and 0.005% for Ce. The upper limits, on the other hand, are defined on the basis of whether coarse inclusions form and degrade mechanical properties, especially ductility and toughness, and from this viewpoint, the upper limits according to the present invention are as follows: 0.01% for Mg and Ca; and 0.1% for Y, La and Ce. When Mg or Ca is added by 0.0005% or more, it brings about an additional effect of suppressing the acidification of the inside of a local corrosion pit and, for this reason, a preferable range of each of the two elements is from 0.0005 to 0.01%.

The reasons for specifying the chemical composition according to the present invention have been explained above. Additionally, the present invention specifies the microscopic segregation conditions of a steel under some conditions of a slab, as required. This is because, in order to obtain good local corrosion resistance, it is necessary that the elements that bring about local corrosion resistance be distributed as uniformly as possible in the entire steel. To this end, it is desirable that the degree of microscopic segregation be low. In addition, when the concentration of a component element, even other than those contributing to the improvement of local corrosion resistance, fluctuates, then local corrosion is accelerated because of the fluctuation. For this reason, the microscopic segregation conditions of a steel are specified in the present invention as required. Since the condition of microscopic segregation is represented virtually by the segregation of Mn, when the microscopic segregation condition is to be specified, in the present invention, the area percentage of microscopic segregation portions where the Mn concentration is 1.2 times or more the average Mn concentration in the steel is set at 10% or less.

The reason the microscopic segregation condition is specified as above is that when the concentration of a component element at a portion is conspicuously high in excess of 1.2 times the average concentration, the concentration difference from the portions depleted of the element becomes significant from the viewpoint of corrosion resistance. It has been confirmed on the basis of precise experiments that corrosion resistance is not adversely affected substantially as long as the ratio of the concentrated portions is 10% or less in terms of area percentage in a section surface. Thus, in the present invention, the microscopic segregation condition is evaluated in terms of the concentration of Mn, and the area percentage of microscopic segregation portions where the Mn concentration is 1.2 times or more the average Mn concentration in the steel is set at 10% or less. A smaller area percentage of microscopic segregation portions is preferable and the optimum lower limit thereof is 0%.

Microscopic segregation is measured by using an X-ray microanalyzer and the area percentage of the portions where the Mn concentration is 1.2 times or more the average Mn concentration is calculated from a concentration map. The measurement is done on a section perpendicular to the plate surface at several points along the thickness of a steel plate from immediately below a plate surface to the thickness center, and the requirement of the present invention should be satisfied at all the measurement points.

Next, explanations are given on the requirements of the present invention regarding the steel production methods for satisfying the above-explained requirements of a steel according to the present invention, mainly for securing the solid solution amount of Mo and W and controlling the state of microscopic segregation. It should be noted, however, that the requirements of a steel according to the present invention may be attained by any means, that is to say, the means to satisfy the requirements is not limited to the production methods stipulated in the present invention.

In the present invention, production methods mainly for securing the amount of Mo and W in solid solution are roughly classified in the following two methods: ① a method employing a thermo-mechanical treatment, or ② a method employing a normalizing treatment after hot rolling. Further, a production method for controlling microscopic segregation requires ③ a method employing a diffusion heat treatment prior to hot rolling in addition to the above both methods of ① and ②. The requirements of the above methods are summarized hereafter.

① In the event of applying a thermo-mechanical treatment wherein an accelerated cooling is applied after hot rolling: the average cooling rate of the accelerated cooling is in the range from 5 to 100° C./sec.; the accelerated cooling end temperature is in the range from 600° C. to 300° C.; the cooling rate in the temperature range from the accelerated cooling end temperature to 100° C. is in the range from 0.1 to 4° C./sec.; and, as required, a tempering or annealing treatment may be applied at 500° C. or lower after the completion of the hot rolling and accelerated cooling.

② In the event of applying a normalizing treatment after hot rolling: the heating temperature of the normalizing treatment is in the range from the $Ac_3$ transformation temperature to 1,000° C.; the average cooling rate from 700° C. to 300° C. is 0.5 to 4° C./sec.; and, as required, a tempering or annealing treatment may be applied at 500° C. or lower.

③ A diffusion heat treatment is applied at a heating temperature of 1,200° C. to 1,350° C. and for a retention time of 2 to 100 hr. prior to hot rolling.

First, the method of the item ① will be explained.

In the event of applying a thermo-mechanical treatment wherein accelerated cooling is applied after hot rolling, the conditions of cooling including the accelerated cooling after hot rolling should be specified for securing a required amount of Mo and W in solid solution.

It is necessary that the average cooling rate of the accelerated cooling, which is done by water cooling or other, be in the range from 5 to 100° C./sec., the accelerated cooling end temperature be in the range from 600° C. to 300° C. and the cooling rate in the temperature range from the accelerated cooling end temperature to 100° C. be in the range from 0.1 to 4° C./sec.

The reasons the lower limit of the cooling rate of the accelerated cooling is set at 5° C./sec are that, if the cooling rate is lower than 5° C./sec., the improvement in strength and toughness is not conspicuous and the application of the accelerated cooling is not recommended and there is the possibility of Mo and W forming precipitates during the cooling, making it difficult to secure the solid solution amount of Mo and W. On the other hand, a larger cooling rate of the accelerated cooling is preferable in terms of the improvement in strength and the suppression of the precipitation of Mo and W. However, when the cooling rate is more than 100° C./sec., a flatness of a steel plate is likely to deteriorate. For this reason, the upper limit of cooling rate of the accelerated cooling is set at 100° C./sec.

The accelerated cooling is finished in the temperature range from 600° C. to 300° C. If an accelerated cooling end temperature is higher than 600° C., then, even if a cooling rate after the end of the accelerated cooling is controlled in the range specified in the present invention, Mo and W form precipitates after the accelerated cooling and a sufficient solid solution amount of Mo and W cannot be secured. Such a case is not desirable, because there is a risk that the corrosion resistance will be somewhat inferior to the case where the solid solution amount of Mo and W specified in the present invention is secured. On the other hand, if the accelerated cooling end temperature is lower than 300° C., undesirably, a toughness level required especially of a steel for a welded structure is secured in some chemical compositions, residual stress increases, and a flatness of a steel plate is likely to deteriorate.

It should be noted that since the influence of an accelerated cooling commencement temperature on the solid solution amount of Mo and W is very small in comparison with an accelerated cooling end temperature, it is not necessary to specify an accelerated cooling commencement temperature. However, it is desirable to commence the accelerated cooling immediately after completing hot rolling in order not to allow strength and toughness to decrease. No significant problem arises if the accelerated cooling is commenced, as a guideline, at the $Ar_3$ transformation temperature or higher.

In order to secure the amount of Mo and W in solid solution steadily, it is necessary to give due consideration to the cooling after finishing the accelerated cooling. If cooling in the temperature range from an accelerated cooling end temperature to 100° C. is slow at a cooling rate lower than 0.1° C./sec., Mo and W may possibly form carbonitrides thereof during such slow cooling. For this reason, in the cases where, for example, the thickness of a steel plate is large and the cooling rate by air cooling inevitably becomes lower than 0.1° C./sec., it is necessary to control the cooling rate so as to be 0.1° C./sec. or higher by means such as shower cooling or gas cooling. A higher rate of cooling is more reliable in the effect of securing the amount of Mo and W in solid solution. However, if the cooling rate is higher than 4° C./sec., the effect is saturated and, also, the cooling rate is differentiated from a cooling rate in the range from 5 to 100° C./sec. controlled in the accelerated cooling after hot rolling, there is a risk that deterioration of toughness, increase in residual stress and other adverse effects will become obvious. For this reason, in the present invention, the upper limit of cooling rate is set at 4° C./sec.

The above-explained hot rolling and cooling process may be the final production process of a steel according to the present invention, but a tempering or annealing treatment may be applied thereafter for the purpose of adjusting material properties. In order to suppress the precipitation of Mo and W during the tempering or annealing treatment and secure the amount of Mo and W in solid solution, it is necessary to limit the temperature in the treatment to 500° C. or lower.

Next, the method of the item ② is explained.

The method of the item ② is the method according to the present invention in the case where a steel is produced through normalizing. Like in the method of the item ①, the conditions of normalizing should be specified for suppressing the precipitation of Mo and W during a normalizing process and securing a required amount of Mo and W in solid solution. It should be noted that, at the time when a steel transforms into single-phase austenite in the heating stage of normalizing, the influences of the thermal history of the steel are dissipated theretofore and for this reason, the conditions of hot rolling prior to the normalizing not have to be specified. Therefore, the hot rolling may be normal continuous hot rolling, a controlled rolling, or a thermo-mechanical processing accompanying accelerated cooling. The history before and after the hot rolling not have to be particularly specified, either.

The basic requirements of the production method of the item ② are that, in the event of applying a normalizing treatment after hot rolling, the heating temperature of the normalizing treatment is in the range from the $Ac_3$ transformation temperature to 1,000° C. and the average cooling rate at the cooling stage from 700 to 300° C. is 0.5 to 4° C./sec.

If a heating temperature is lower than the $Ac_3$ transformation temperature, it is impossible to sufficiently dissolve the parts of Mo and W that have precipitated before the normalizing treatment and, as a result, corrosion resistance deteriorates. Another adverse effect is that the metallographic structure becomes uneven, and the strength and ductility deteriorate. On the other hand, if the heating temperature is higher than 1,000° C., austenite grains become coarse by the heating, the final transformation structure becomes coarse as a consequence, and toughness is lowered significantly. For this reason, the heating temperature of the normalizing treatment is specified to be in the range from the $Ac_3$ transformation temperature to 1,000° C. in the present invention.

In an ordinary normalizing process, the cooling after heating and retention is done by air cooling. However, in the present invention, in the case where air cooling is too slow to secure the amount of Mo and W in solid solution, it is necessary to control the cooling rate so that the average cooling rate in the range from 700° C. to 300° C. may be 0.5 to 4° C./sec. by any practical means. If the average cooling rate in the range from 700° C. to 300° C. is lower than 0.5° C./sec., Mo and W form precipitates during the cooling and the possibility that the solid solution amount of Mo and W in the range specified in the present invention is not secured becomes significantly high. A higher cooling rate of normalizing is more reliable in terms of securing the solid solution amount of Mo and W. However, if the cooling rate exceeds 4° C./sec., the effect is saturated and there is a risk that deterioration of toughness, increase in residual stress and other adverse effects will become obvious. For this reason, in the present invention, the upper limit of cooling rate is set at 4° C./sec. A normalizing treatment without an accelerated cooling is different from the method of the item ① and, for this reason, a cooling rate in the temperature range of lower than 300° C. is not specified in the present invention. However, such slow cooling that an average cooling rate in the temperature range from 300° C. to 100° C. is far lower than 0.1° C./sec. is undesirable.

The above-explained normalizing process may be the final production process of a steel according to the present invention, but a tempering or annealing treatment may be applied thereafter for the purpose of adjusting material properties. In order to suppress the precipitation of Mo and W during the tempering or annealing treatment and secure the amount of Mo and W in solid solution, it is necessary to limit the temperature in the treatment to 500° C. or lower.

Finally, the production method of the item ③ will be explained. The method of the item ③ is a means to satisfy the requirements of the present invention regarding microscopic segregation, and the basic requirements thereof are that, prior to hot rolling, a diffusion heat treatment is applied at a heating temperature of 1,200° C. to 1,350° C. and for a retention time of 2 to 100 hr. in the heating temperature range. Elements that have segregated microscopically are diffused by a diffusion heat treatment and thus the incrassation of the microscopic segregation portions is lowered. If the heating temperature of the diffusion heat treatment is lower than 1,200° C., the diffusion rates of the elements are too low to obtain a sufficient diffusion effect with a practical retention time. As the heating temperature increases, though the diffusion rate also increases favorably for the mitigation of segregation, austenite grains grow too coarse by the heating, and there is a risk that a coarse structure will remain through the hot rolling and heat treatment after the diffusion treatment and adversely affect the mechanical properties of the steel, and the possibility of a rough surface forming on the steel sheet surface increases. For this reason, in the present invention, the upper limit of heating temperature of the diffusion heat treatment is set at 1,350° C. in consideration of practically acceptable degrees of the above adverse effects.

When the heating temperature of the diffusion heat treatment is maintained in the range from 1,200° C. to 1,350° C., a retention time of 2 hr. or more is required for sufficiently dissipating microscopic segregation. The longer the retention time, the more the diffusion progresses. However, as far as the microscopic segregation usually seen in a steel ingot or slab is concerned, a sufficient effect of a diffusion heat treatment is obtained after a retention time of 100 hr. For this reason, in consideration also of economical efficiency, the upper limit of retention time of the diffusion treatment is set at 100 hr. in the present invention.

It is not necessary to specify the conditions of cooling after the retention for 2 to 100 hr. at 1,200° C. to 1,350° C. However, if diffusion is expected to continue during the cooling, it is desirable to adopt slow cooling at a cooling rate equal to or less than that of air cooling.

Here, if it is intended to apply a diffusion heat treatment after hot rolling, the capacity of a heat treatment furnace may possibly be a practical problem, since the dimensions of a steel becomes larger after hot rolling and it is necessary to fractionize a metallographic structure that has once coarsened by the diffusion heat treatment. Therefore, the present invention stipulates that a diffusion heat treatment be applied before hot rolling. However, in the method of the item ②, if the above problems do not arise, then a diffusion heat treatment may be applied after hot rolling and before the normalizing treatment. In this case, the effects of the diffusion treatment are not in the least reduced.

Next, a crude oil tank made of a steel according to the present invention will be described. When a steel according to the present invention is used wholly or partially for the floor plate, deck plate, side walls and structural members of a crude oil tank, the rate of progress of local corrosion occurring inside the tank is significantly reduced, and as a consequence the frequency of repair work of the tank is reduced and safety is enhanced. The effects obtained with a crude oil tank for which a steel according to the present invention is used is explained below in further detail in comparison with another for which an ordinary steel is used.

High-concentration brine contained in crude oil separates and settles at the bottom of an oil tank, and local corrosion occurs at various portions of the tank. Local corrosion inevitably occurs, especially at the floor plate and side walls. When a steel according to the present invention is used for those portions of a tank where local corrosion occurs or for all of it in accordance with the structure of the oil tank, the local corrosion rate of progress is significantly reduced. A crude oil tank excellent in durability and economical efficiency can be constructed by using a steel according to the present invention selectively for those portions that cannot be thoroughly washed for structural reasons and are continuously exposed to high-concentration brine.

As a general rule, a crude oil tank is legally obliged to undergo periodical overhaul inspections wherein the positions and depths of local corrosion are inspected and pitting corrosion portions deeper than a prescribed figure are repaired by a method such as padding welding. In the case of a crude oil tank using a steel according to the present invention, as long as the interval of the periodical inspections is kept unchanged, the number of pitting corrosion that requires repair is drastically decreased, and the costs and time required for repair work are significantly reduced. Further, even if progressive local corrosion at some portion of such a tank is overlooked in inspection and eventually not repaired, the probability of the local corrosion developing into a through hole leading to an oil leakage accident is less in comparison with a crude oil tank for which an ordinary steel is used, when the steel thickness is identical. Thus, the present invention contributes to the enhancement of the safety of a crude oil tank. The use of a steel according to the present invention makes it possible to construct a crude oil tank excellent in economical efficiency and safety with the same level of welding workability and mechanical properties of a steel as in the case where an ordinary steel is used. In addition, when a steel according to the present invention is used for the deck or ceiling plate of a crude oil tank, the formation of sludge at the reverse side of a deck or ceiling plate is significantly reduced, and consequently, the costs for recovering the sludge can be reduced as well.

The effects of the present invention are explained below in further detail on the basis of examples. It should be noted that the present invention should not be interpreted as being limited to the examples described below.

Example

Specimen steels were melted and refined with a vacuum melting furnace or a converter, cast into ingots or slabs and hot rolled into steel plates. Table 1 shows the chemical compositions of the specimen steels and Table 2 the production conditions of the steel plates. In producing the steel plates, the conditions of diffusion heat treatment, hot rolling, normalizing and tempering and the combination of these processes were changed so that the effects of the production method according to the present invention might be clearly shown. Note that Table 2 also shows the measurement results of the amounts of Mo and W in solid solution and the conditions of microscopic segregation of Mn in the specimen steel plates. The amounts of solute Mo and W were measured by extraction residue analysis using through-thickness test pieces of the specimen plates removed of oxide skin. The microscopic segregation was measured with an X-ray microanalyzer on a section perpendicular to the surface of the steel plate at three points, namely 1 mm from the surface, ¼ of the plate thickness and at the thickness center, and the area percentage of the portions where the Mn concentration was 1.2 times or more the average Mn concentration was calculated from a concentration map by image analysis.

Table 3 shows the mechanical properties (strengths and 2-mm V-notch Charpy impact test results) of the specimen steel plates and the maximum hardness of HAZ, as an indicator of their weldability. Tables 4 and 5 show the results of corrosion tests: Table 4 shows the results of tests to evaluate mainly local corrosion resistance, and Table 5 the results of tests to evaluate mainly general corrosion resistance and sludge formation behaviors.

With respect to the mechanical properties of the specimen steel plates, strength and toughness were measured through round bar tensile tests and 2-mm V-notch Charpy impact tests, and the test pieces were cut out from the thickness center so that their longitudinal direction was at right angles to the rolling direction of the specimen plates. The tensile tests were carried out at the room temperature. The 2-mm V-notch Charpy impact tests were carried out at different temperatures, and the fracture appearance transition temperature calculated from the transition curve was used as an indicator of toughness.

The maximum hardness of HAZ was tested according to JIS Z 3101 without preheating.

The conditions of the tests, which are shown in Table 4, to evaluate mainly local corrosion resistance are as follows:

Test pieces 40 mm in length, 40 mm in width and 4 mm in thickness were cut out so that the thickness center of the test pieces coincided with the ¼ thickness of the specimen steel plates. All the surfaces of the test pieces were mechanically polished, then wet polished to #600 finish by the surface roughness code, and then their edge faces were coated with paint, leaving the top and bottom 40 mm×40 mm faces without coating. Then, the test pieces were immersed in two different corrosive liquids, namely 10- and 20-mass-% aqueous solutions of NaCl, whose values of pH had been adjusted to 0.2 with hydrochloric acid. Other immersion conditions were the liquid temperature of 30° C. and the immersion time of 24 hr. to 4 weeks, and then corrosion weight loss was measured for evaluating the corrosion rate. The compositions of the corrosive liquids were those simulating the conditions of the environments where local corrosion occurred to real steel structures and therefore, as the corrosion rate of a steel at the corrosion test decreases, the rate of progress of local corrosion of the steel in a real environment decreases.

Figure 5:
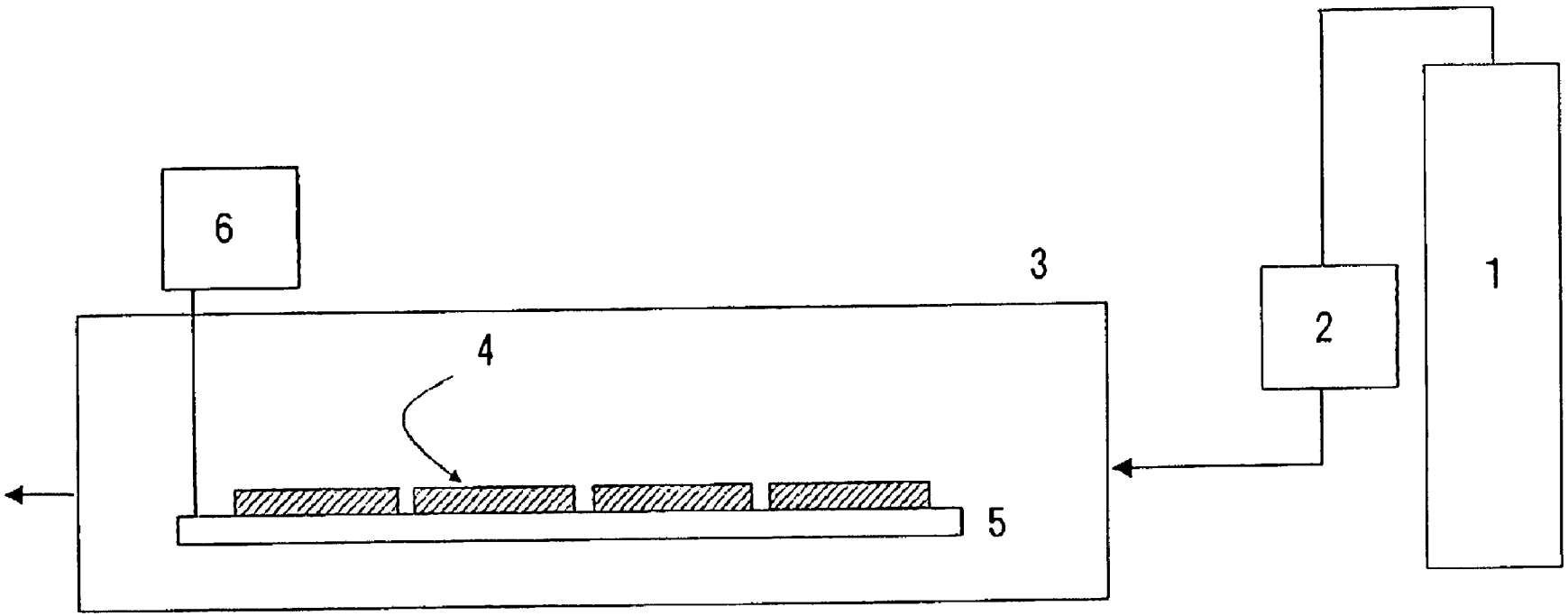
FIG. 5 is a schematic configuration diagram of a corrosion test apparatus.
Figure 6:
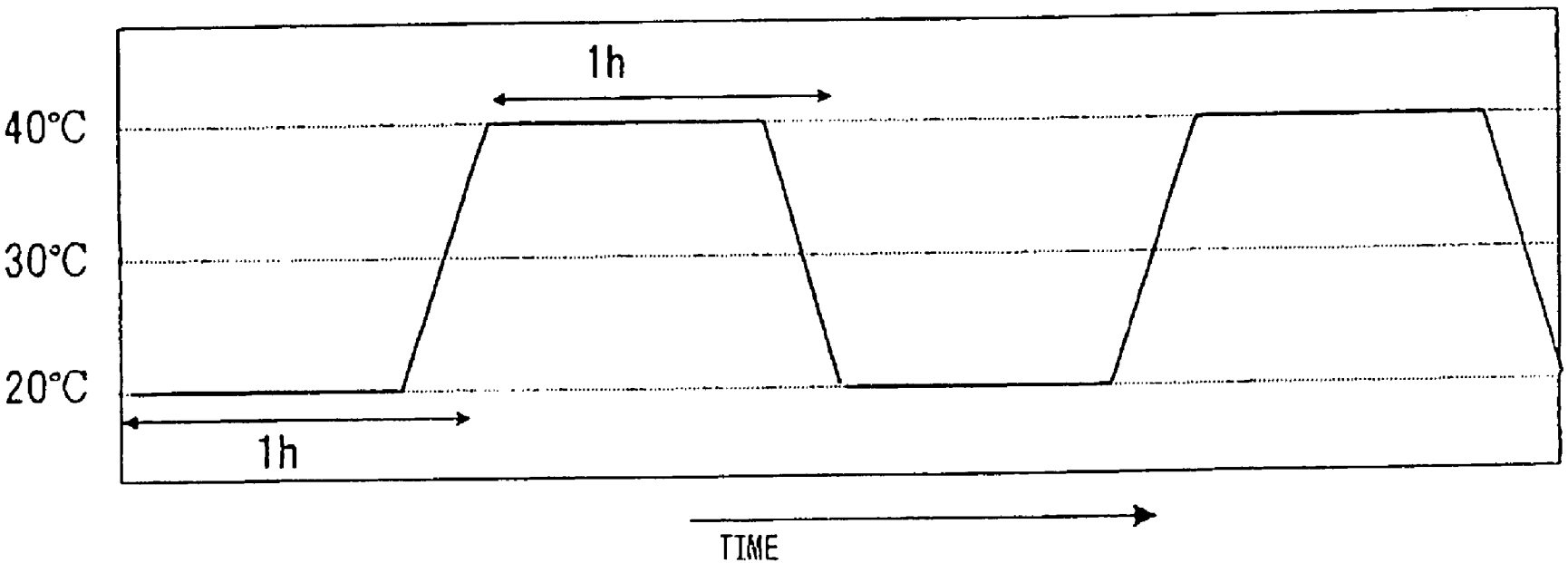
FIG. 6 is a graph explaining the temperature cycle imposed on test pieces.

The conditions of the tests, which are shown in Table 5, to examine general corrosion resistance and the formation behavior of sludge are as follows:

Test pieces 40 mm in length, 40 mm in width and 4 mm in thickness were cut out so that the thickness center of the test pieces coincided with the ¼ thickness of the specimen steel plates. All the surfaces of the test pieces were mechanically polished, then wet polished to #600 finish by the surface roughness code, and their edge faces and one of the top and bottom 40 mm×40 mm faces were coated with paint, leaving the other 40 mm×40 mm face without paint coating. The corrosion rates and the formation rates of sludge composed mainly of solid sulfur of the specimen steels were evaluated with a test apparatus as schematically shown in FIG. 5. Table 6 shows the composition of the atmosphere gas that was used for the above corrosion tests.

The dew point of the atmosphere gas was adjusted to a prescribed temperature (30° C.) by making the gas pass through a dew point adjustment water tank 2 and then the gas was introduced to a test chamber 3. The surface of each of the test pieces 4 left without paint coating was coated with an aqueous solution of NaCl prior to the tests so that the deposition amount of NaCl was 1,000 mg/m$^2$ and then, after drying, the test pieces were placed horizontally on a constant-temperature heating plate 5 in the test chamber. The temperature cycle shown in FIG. 7, 20° C.×1 hr.+40° C.×1 hr., in total 2 hr. per cycle, was repeated by controlling a heater controller 6 so that wet and dry were repeated alternately at the surfaces of the test pieces. After 720 cycles, the rate of corrosion was evaluated from corrosion weight loss, and the rate of sludge formation from the mass of corrosion products that formed on the surface of each test piece. Here, it has been confirmed through chemical and x-ray analyses at preliminary tests that the corrosion products consist of iron oxyhydroxide (iron rust) and solid sulfur.

First, with respect to mechanical properties, it is clear from the results shown in Table 3 that every one of the steel plate nos. A1 to A26, which satisfy the requirements of the present invention, has sufficiently good properties as a steel for a welded structure. Further, with respect to weldability, it is clear that every one of the steel plates of the invention samples that have a value of the carbon equivalent defined by expression (1) equal to or less than 0.4% exhibits a maximum HAZ hardness of 300 or less in terms of Vickers hardness, and thus has good weldability.

It should be noted that, although the steel plate no. A25 is an invention sample, the amount of solute Mo is smaller than two other invention samples (the steel plate nos. A1 and A11) of the same chemical composition and therefore it is somewhat inferior in local corrosion resistance. Nevertheless, it is significantly superior in corrosion resistance to comparative samples.

Although the steel plate no. A26 satisfies the chemical composition stipulated in the present invention, the total amount of Mo and W in solid solution is slightly smaller than two other invention samples (the steel plate nos. A6 and A13) of the same chemical composition and therefore it is somewhat inferior in local corrosion resistance. Nevertheless, it is significantly superior in corrosion resistance to comparative samples.

Figure 4:
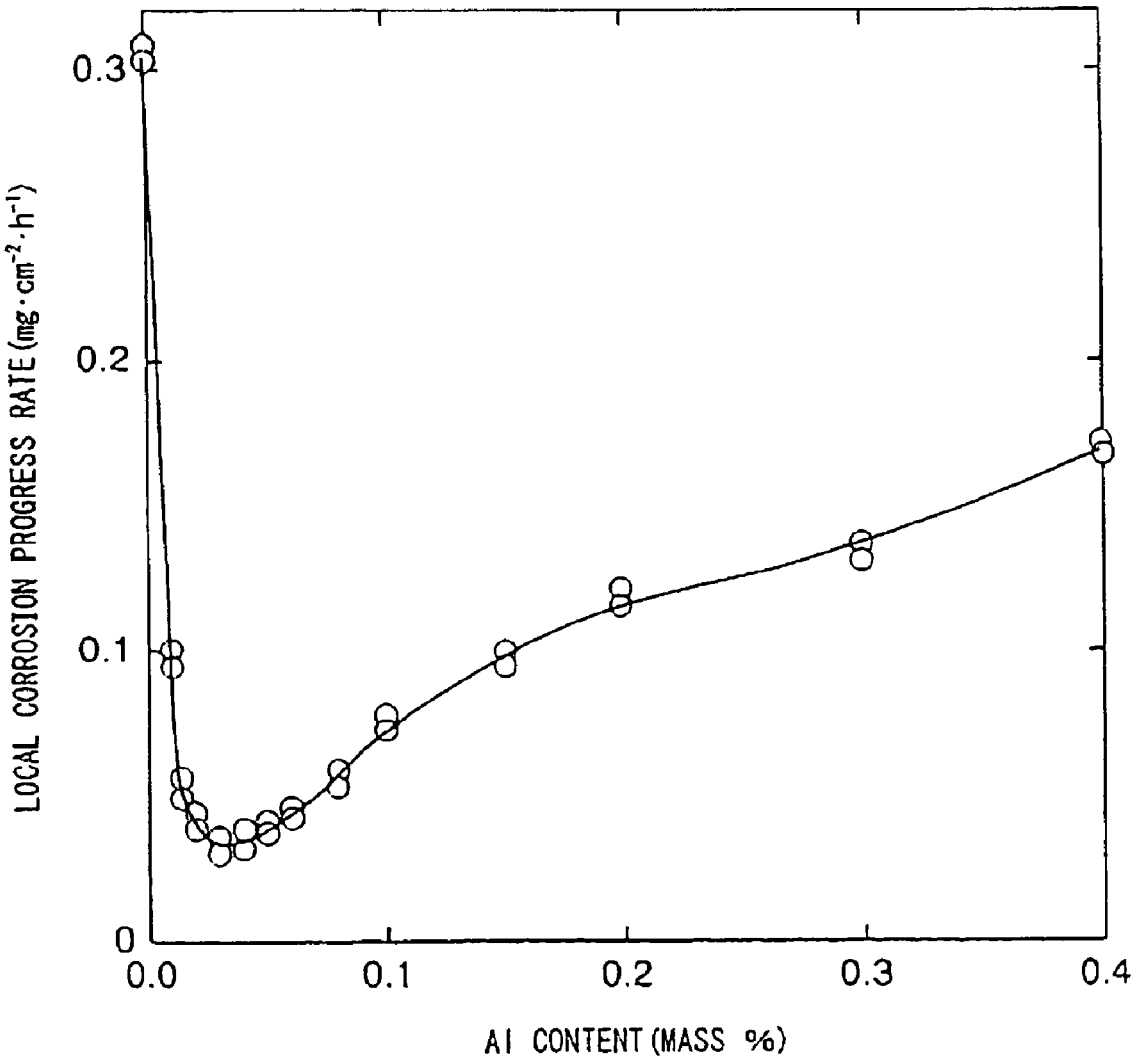
FIG. 4 is a graph showing the relationship between a local corrosion rate of progress and the Al content of Fe—Cu—Mo steels.

From the local corrosion resistance shown in Table 4 and the general corrosion resistance and the amount of sludge formation shown in Table 5, it has been clarified that: the corrosion rates and sludge formation rates of all the invention samples are suppressed to roughly ¼ times or less those of the comparative steel plate no. B1, which is of virtually the same chemical composition as an ordinary steel and does not contain any of Cu, Mo and W, the indispensable elements of the present invention; and thus all the invention samples have remarkably improved corrosion resistance. With respect to local corrosion resistance shown in FIG. 4 in particular, further enhancement of local corrosion resistance is realized in those invention samples wherein microscopic segregation is very little or it is reduced through diffusion heat treatment so that the area percentage of the microscopic segregation portions where the Mn concentration is 1.2 times or more the average Mn concentration of the steel is 10% or less.

On the other hand, the steel plates nos. B1 to B9 are comparative samples which are inferior in corrosion resistance to invention samples, because some of the requirements of the present invention are not satisfied.

The steel plate no. B1 (slab no. 31) does not contain any of Cu, Mo and W, which are indispensable for decreasing local corrosion and the formation of sludge and, as a natural result, does not contain the required amount of Mo and W in solid solution and, consequently, is significantly inferior to the invention samples in any of local corrosion resistance, general corrosion resistance and resistance to sludge formation.

The steel plate no. B2 (slab no. 32) contains Cu but neither Mo nor W and, as a result, is significantly inferior to the invention samples in any of local corrosion resistance, general corrosion resistance and resistance to sludge formation.

The steel plate no. B3 (slab no. 33) contains Mo but not Cu, and fails to realize the effects of the present invention and, as a result, is significantly inferior to the invention samples in any of local corrosion resistance, general corrosion resistance and resistance to sludge formation.

The steel plate no. B4 (slab no. 34) contains an excessive amount of Cr and, as a result, is inferior to the invention samples in corrosion resistance. The local corrosion resistance of this specimen, especially in a corrosive environment of a high salt concentration (corresponding to corrosion condition ② in Table 4), is significantly inferior to that of an ordinary steel.

The steel plate no. B5 (slab no. 35) contains an excessive amount of P and, as a result, is inferior to the invention samples in any of local corrosion resistance, general corrosion resistance and resistance to sludge formation. This specimen shows a tendency toward a larger sludge formation.

The steel plate no. B6 (slab no. 36) contains an excessive amount of S and, as a result, is inferior to the invention samples in any of local corrosion resistance, general corrosion resistance and resistance to sludge formation. This specimen also shows a tendency toward larger sludge formation.

The steel plate no. B7 (slab no. 37) contains Al by an amount less than the lower limit stipulated in the present invention and; as a result, is inferior to the invention samples in local corrosion resistance. This specimen also shows a tendency toward larger sludge formation.

The steel plate no. B8 (slab no. 38) contains an excessive amount of Al and, as a result, is inferior to the invention samples in local corrosion resistance. This specimen also shows a tendency toward larger sludge formation. The toughness is also poor.

The steel plate no. B9 (slab no. 39) contains an excessive amount of Mo and, as a result, is inferior to the invention samples in local corrosion resistance. This specimen also shows a tendency toward larger sludge formation. The toughness and weldability are also poor.

From the examples described above, it is obvious that the present invention makes it possible to secure excellent general and local corrosion resistance to such crude oil corrosion as caused in a steel oil tank for transporting or storing crude oil, and to suppress the formation of corrosion products (sludge) containing solid sulfur.

TABLE 1

| Classification | Slab no. | Chemical components (mass %) | | | | | | | | | | | | |
|---|---|---|---|---|---|---|---|---|---|---|---|---|---|---|
| | | C | Si | Mn | P | S | Al | N | Cu | Ni | Co | Cr | Mo | W |
| Invention sample | 1 | 0.15 | 0.33 | 1.13 | 0.010 | 0.008 | 0.035 | 0.0035 | 0.26 | — | — | 0.003 | 0.046 | — |
| | 2 | 0.14 | 0.21 | 1.46 | 0.008 | 0.003 | 0.046 | 0.0032 | 0.35 | — | — | 0.012 | 0.078 | — |
| | 3 | 0.09 | 0.19 | 1.37 | 0.008 | 0.002 | 0.016 | 0.0041 | 0.33 | 0.25 | — | 0.005 | 0.051 | — |
| | 4 | 0.06 | 0.09 | 1.01 | 0.006 | 0.002 | 0.011 | 0.0036 | 0.35 | 0.65 | — | 0.003 | 0.075 | — |
| | 5 | 0.11 | 0.25 | 1.48 | 0.006 | 0.004 | 0.019 | 0.0040 | 0.45 | 0.11 | — | 0.005 | — | 0.044 |
| | 6 | 0.11 | 0.29 | 1.33 | 0.009 | 0.003 | 0.037 | 0.0029 | 0.34 | 0.16 | — | 0.003 | 0.030 | 0.031 |
| | 7 | 0.10 | 0.26 | 1.35 | 0.011 | 0.004 | 0.020 | 0.0037 | 0.25 | 0.13 | 0.10 | 0.009 | 0.065 | 0.047 |
| | 8 | 0.09 | 0.21 | 0.93 | 0.007 | 0.002 | 0.055 | 0.0031 | 0.27 | 0.96 | — | 0.006 | 0.200 | — |
| | 9 | 0.05 | 0.18 | 1.32 | 0.008 | 0.003 | 0.010 | 0.0022 | 0.31 | 0.13 | — | 0.003 | 0.052 | — |
| | 10 | 0.07 | 0.23 | 1.05 | 0.010 | 0.001 | 0.023 | 0.0033 | 0.24 | — | 0.15 | 0.002 | — | 0.049 |
| | 11 | 0.12 | 0.20 | 0.95 | 0.005 | 0.004 | 0.030 | 0.0040 | 0.49 | 0.29 | — | 0.002 | 0.050 | — |
| | 12 | 0.11 | 0.21 | 1.00 | 0.015 | 0.004 | 0.029 | 0.0039 | 0.15 | 0.09 | — | 0.050 | 0.074 | — |
| | 13 | 0.10 | 0.23 | 1.34 | 0.009 | 0.003 | 0.033 | 0.0045 | 0.09 | — | — | 0.020 | 0.020 | — |
| | 14 | 0.11 | 0.22 | 1.15 | 0.005 | 0.003 | 0.025 | 0.0038 | 0.05 | 0.11 | — | 0.010 | 0.055 | — |
| | 15 | 0.17 | 0.20 | 1.00 | 0.005 | 0.005 | 0.027 | 0.0041 | 0.31 | 0.31 | — | 0.010 | 0.069 | — |
| | 16 | 0.12 | 0.20 | 0.95 | 0.005 | 0.004 | 0.030 | 0.0040 | 0.31 | 0.32 | — | 0.010 | 0.030 | — |
| | 17 | 0.12 | 0.20 | 0.95 | 0.005 | 0.004 | 0.030 | 0.0040 | 0.31 | 0.32 | — | 0.010 | 0.051 | — |
| Comparative sample | 31 | 0.15 | 0.54 | 1.16 | 0.015 | 0.005 | 0.037 | 0.0046 | — | — | — | 0.005 | — | — |
| | 32 | 0.13 | 0.26 | 1.45 | 0.013 | 0.003 | 0.029 | 0.0055 | 0.51 | 0.16 | — | 0.003 | — | — |
| | 33 | 0.12 | 0.34 | 1.47 | 0.010 | 0.002 | 0.030 | 0.0040 | — | — | — | 0.005 | 0.033 | — |
| | 34 | 0.13 | 0.51 | 0.95 | 0.015 | 0.003 | 0.026 | 0.0039 | 0.32 | 0.33 | — | 0.260 | 0.053 | — |

TABLE 1-continued

| | | | | | | | | | | | | | |
|---|---|---|---|---|---|---|---|---|---|---|---|---|---|
| 35 | 0.12 | 0.25 | 1.05 | 0.054 | 0.005 | 0.027 | 0.0041 | 0.39 | 0.38 | — | 0.010 | 0.075 | 0.050 |
| 36 | 0.13 | 0.28 | 1.25 | 0.020 | 0.025 | 0.030 | 0.0044 | 0.25 | 0.22 | — | 0.005 | 0.029 | — |
| 37 | 0.11 | 0.25 | 1.10 | 0.014 | 0.005 | — | 0.0045 | 0.21 | 0.21 | — | 0.005 | 0.105 | 0.125 |
| 38 | 0.11 | 0.25 | 1.10 | 0.015 | 0.007 | 0.450 | 0.0045 | 0.31 | 0.31 | — | 0.005 | 0.130 | — |
| 39 | 0.12 | 0.22 | 1.37 | 0.019 | 0.005 | 0.028 | 0.0041 | 0.49 | 0.45 | — | 0.090 | 0.310 | — |

| Classification | Slab no. | Chemical components (mass %) | | | | | | | | | | | | | | | Equation (1) |
|---|---|---|---|---|---|---|---|---|---|---|---|---|---|---|---|---|---|
| | | Nb | Ta | V | Ti | Zr | B | Sb | Sn | As | Bi | Mg | Ca | Y | La | Ce | Ceq. |
| Invention sample | 1 | — | — | — | — | — | — | — | — | — | — | — | — | — | — | — | 0.365 |
| | 2 | 0.009 | — | — | 0.012 | — | — | — | — | — | — | — | — | — | — | — | 0.425 |
| | 3 | 0.015 | — | — | 0.009 | — | — | 0.03 | — | — | — | — | 0.0018 | — | — | — | 0.368 |
| | 4 | 0.010 | — | 0.025 | 0.008 | — | 0.0013 | — | — | — | — | — | 0.0016 | — | — | — | 0.316 |
| | 5 | 0.023 | — | 0.055 | 0.015 | — | — | — | 0.05 | 0.04 | — | 0.0009 | — | — | — | — | 0.415 |
| | 6 | — | 0.08 | — | 0.008 | — | 0.0006 | — | — | — | — | — | — | 0.0011 | — | — | 0.378 |
| | 7 | 0.008 | — | 0.020 | 0.011 | 0.007 | 0.0003 | — | — | — | 0.05 | — | 0.0025 | — | 0.005 | — | 0.379 |
| | 8 | — | — | 0.047 | — | — | 0.0015 | 0.02 | 0.02 | 0.01 | — | — | 0.0018 | 0.0021 | — | — | 0.378 |
| | 9 | 0.006 | — | — | 0.010 | — | — | — | 0.03 | — | 0.01 | — | 0.0009 | 0.0110 | — | 0.008 | 0.310 |
| | 10 | 0.006 | 0.06 | — | 0.009 | 0.009 | — | — | 0.02 | 0.05 | 0.02 | 0.0015 | 0.0100 | 0.0080 | 0.009 | — | 0.271 |
| | 11 | 0.006 | — | — | 0.014 | — | — | — | — | — | — | — | — | — | — | — | 0.341 |
| | 12 | 0.007 | — | — | 0.013 | — | — | — | — | — | — | — | — | — | — | — | 0.317 |
| | 13 | 0.010 | — | 0.020 | — | — | — | — | — | — | — | — | — | — | — | — | 0.341 |
| | 14 | 0.006 | — | — | 0.012 | — | — | — | — | — | — | — | — | — | — | — | 0.325 |
| | 15 | 0.006 | — | — | 0.012 | — | — | — | — | — | — | — | — | — | — | — | 0.394 |
| | 16 | 0.005 | — | — | 0.012 | — | — | — | — | — | — | — | — | — | — | — | 0.328 |
| | 17 | 0.006 | — | — | 0.012 | — | — | 0.09 | — | — | — | — | — | — | — | — | 0.333 |
| Comparative sample | 31 | 0.010 | — | — | 0.011 | — | — | — | — | — | — | — | — | — | — | — | 0.344 |
| | 32 | 0.014 | — | — | 0.013 | — | — | — | 0.03 | — | — | — | 0.0018 | — | — | — | 0.417 |
| | 33 | 0.010 | — | — | 0.005 | — | — | — | — | — | — | — | — | — | — | — | 0.373 |
| | 34 | 0.015 | — | — | 0.012 | — | — | — | — | — | — | — | — | — | — | — | 0.394 |
| | 35 | — | — | — | — | — | — | — | — | — | — | — | — | — | — | — | 0.373 |
| | 36 | — | — | — | 0.010 | — | — | — | — | — | — | — | — | — | — | — | 0.376 |
| | 37 | — | — | — | — | — | — | — | — | — | — | — | — | — | — | — | 0.368 |
| | 38 | — | — | — | — | — | — | — | — | — | — | — | — | — | — | — | 0.362 |
| | 39 | — | — | — | — | — | — | — | — | — | — | — | — | — | — | — | 0.491 |

TABLE 2

| | | | Slab production method (Note 1) | | Diffusion heat treatment conditions | | | Hot rolling conditions |
|---|---|---|---|---|---|---|---|---|
| Classification | Steel plate no. | Slab no. | Process route | Slab thickness (nm) | Heating temperature (° C.) | Retention time (h) | Cooling condition (Note 2) | Reheating temperature (° C.) |
| Invention sample | A1 | 1 | Converter - continuous casting | 200 | — | — | — | 1200 |
| | A2 | 2 | Converter - continuous casting | 250 | — | — | — | 1250 |
| | A3 | 3 | Converter - continuous casting | 200 | 1300 | 4 | AC | 1150 |
| | A4 | 4 | Vacuum melting - ingot casting | 100 | — | — | — | 1250 |
| | A5 | 5 | Converter - continuous casting | 200 | — | — | — | 1200 |
| | A6 | 6 | Converter - continuous casting | 250 | 1250 | 6 | AC | 1050 |
| | A7 | 7 | Vacuum melting - ingot casting | 120 | — | — | — | 1150 |
| | A8 | 8 | Vacuum melting - ingot casting | 120 | 1300 | 4 | AC | 1050 |
| | A9 | 9 | Vacuum melting - ingot casting | 120 | — | — | — | 1250 |
| | A10 | 10 | Vacuum melting - ingot casting | 120 | 1250 | 10 | FC | 1000 |
| | A11 | 11 | Converter - continuous casting | 280 | 1250 | 10 | AC | 1250 |
| | A12 | 12 | Vacuum melting - ingot casting | 150 | — | — | — | 1270 |
| | A13 | 13 | Vacuum melting - ingot casting | 120 | 1300 | 2 | FC | 1200 |
| | A14 | 14 | Vacuum melting - ingot casting | 150 | — | — | — | 1250 |
| | A15 | 15 | Converter - continuous casting | 200 | — | — | — | 1200 |
| | A16 | 16 | Converter - continuous casting | 200 | — | — | — | 1200 |
| | A17 | 17 | Converter - continuous casting | 200 | — | — | — | 1200 |
| | A18 | 1 | Converter - continuous casting | 200 | — | — | — | 1200 |
| | A19 | 2 | Converter - continuous casting | 250 | 1300 | 6 | AC | 1250 |
| | A20 | 6 | Converter - continuous casting | 250 | 1350 | 4 | AC | 1050 |
| | A21 | 11 | Converter - continuous casting | 280 | — | — | — | 1250 |
| | A22 | 15 | Converter - continuous casting | 200 | 1250 | 10 | AC | 1200 |
| | A23 | 16 | Converter - continuous casting | 200 | — | — | — | 1200 |
| | A24 | 17 | Converter - continuous casting | 200 | 1200 | 24 | AC | 1200 |
| | A25 | 1 | Converter - continuous casting | 200 | — | — | — | 1200 |
| | A26 | 6 | Converter - continuous casting | 250 | 1250 | 5 | AC | 1150 |

TABLE 2-continued

| | | | | | | | | |
|---|---|---|---|---|---|---|---|---|
| Comparative sample | B1 | 31 | Converter - continuous casting | 200 | — | — | — | 1250 |
| | B2 | 32 | Converter - continuous casting | 200 | — | — | — | 1250 |
| | B3 | 33 | Vacuum melting - ingot casting | 100 | — | — | — | 1200 |
| | B4 | 34 | Converter - continuous casting | 200 | — | — | — | 1250 |
| | B5 | 35 | Converter - continuous casting | 200 | — | — | — | 1250 |
| | B6 | 36 | Converter - continuous casting | 250 | 1250 | 4 | AC | 1150 |
| | B7 | 37 | Converter - continuous casting | 200 | — | — | — | 1250 |
| | B8 | 38 | Converter - continuous casting | 150 | — | — | — | 1200 |
| | B9 | 39 | Converter - continuous casting | 250 | 1200 | 10 | AC | 1100 |

| | | | Hot rolling conditions | | | | |
|---|---|---|---|---|---|---|---|
| Classification | Steel plate no. | Slab no. | Rolling commencement temperature (° C.) | Rolling end temperature (° C.) | Cumulative reduction ratio (%) | Steel plate thickness (mm) | $Ar_3$ (° C.) (Note 3) |
| Invention sample | A1 | 1 | 1050 | 980 | 88 | 25 | 775 |
| | A2 | 2 | 1120 | 940 | 84 | 40 | 750 |
| | A3 | 3 | 980 | 870 | 88 | 25 | 760 |
| | A4 | 4 | 1150 | 1000 | 75 | 25 | 775 |
| | A5 | 5 | 1130 | 920 | 75 | 50 | 750 |
| | A6 | 6 | 900 | 800 | 84 | 40 | 760 |
| | A7 | 7 | 1000 | 850 | 83 | 20 | 750 |
| | A8 | 8 | 970 | 890 | 58 | 50 | 750 |
| | A9 | 9 | 1130 | 1000 | 83 | 220 | 775 |
| | A10 | 10 | 930 | 860 | 75 | 30 | 780 |
| | A11 | 11 | 1150 | 1030 | 91 | 25 | 770 |
| | A12 | 12 | 1120 | 860 | 87 | 20 | 785 |
| | A13 | 13 | 1090 | 850 | 79 | 25 | 770 |
| | A14 | 14 | 1100 | 880 | 90 | 15 | 765 |
| | A15 | 15 | 1060 | 910 | 90 | 20 | 750 |
| | A16 | 16 | 1050 | 890 | 90 | 20 | 770 |
| | A17 | 17 | 1050 | 900 | 90 | 20 | 770 |
| | A18 | 1 | 1050 | 980 | 88 | 25 | 775 |
| | A19 | 2 | 1130 | 950 | 84 | 40 | 750 |
| | A20 | 6 | 900 | 820 | 84 | 40 | 760 |
| | A21 | 11 | 1120 | 1000 | 91 | 25 | 770 |
| | A22 | 15 | 1070 | 900 | 90 | 20 | 750 |
| | A23 | 16 | 1050 | 890 | 90 | 20 | 770 |
| | A24 | 17 | 1040 | 880 | 90 | 20 | 770 |
| | A25 | 1 | 1070 | 990 | 75 | 50 | 780 |
| | A26 | 6 | 980 | 890 | 84 | 40 | 765 |
| Comparative sample | B1 | 31 | 1130 | 930 | 88 | 25 | 780 |
| | B2 | 32 | 1120 | 930 | 88 | 25 | 745 |
| | B3 | 33 | 1030 | 900 | 75 | 25 | 760 |
| | B4 | 34 | 1150 | 950 | 88 | 25 | 770 |
| | B5 | 35 | 1130 | 900 | 88 | 25 | 760 |
| | B6 | 36 | 1060 | 850 | 92 | 20 | 770 |
| | B7 | 37 | 1150 | 930 | 88 | 25 | 780 |
| | B8 | 38 | 1090 | 900 | 83 | 25 | 760 |
| | B9 | 39 | 980 | 860 | 90 | 25 | 715 |

| | | | Accelerated cooling conditions (Note 4) | | | Cooling | | | |
|---|---|---|---|---|---|---|---|---|---|
| | | | | | | | Normalizing conditions (Note 6) | | |
| Classification | Steel plate no. | Slab no. | Accelerated cooling commencement tempurature (° C.) | Accelerated cooling end temperature (° C.) | Accelerated cooling rate (° C./s) | rate after accelerated cooling (° C./sec.) (Note 5) | $Ac_3$ transformation temperature (° C.) (Note 7) | Heating temperature (° C.) | Cooling rate (° C./sec.) (Note 6) |
| Invention sample | A1 | 1 | 850 | 450 | 25 | 0.11 | — | — | — |
| | A2 | 2 | 800 | 350 | 15 | 0.10 | — | — | — |
| | A3 | 3 | 780 | 500 | 25 | 0.13 | — | — | — |
| | A4 | 4 | — | — | — | — | 880 | 950 | 1.0 |
| | A5 | 5 | 850 | 450 | 10 | 0.15 | 865 | 930 | 0.5 |
| | A6 | 6 | — | — | — | — | 870 | 950 | 0.5 |
| | A7 | 7 | — | — | — | — | 870 | 900 | 1.0 |
| | A8 | 8 | 820 | 350 | 10 | 0.15 | — | — | |
| | A9 | 9 | — | — | — | — | 890 | 550 | 0.8 |
| | A10 | 10 | 810 | 300 | 20 | 0.12 | 395 | 930 | 0.6 |
| | A11 | 11 | 900 | 500 | 25 | 0.22 | — | — | — |
| | A12 | 12 | 800 | 300 | 30 | 0.26 | — | — | — |
| | A13 | 13 | — | — | — | — | 380 | 910 | 1.0 |
| | A14 | 14 | 810 | 500 | 30 | 0.33 | — | — | — |

TABLE 2-continued

| | | | | | | | | | |
|---|---|---|---|---|---|---|---|---|---|
| | A15 | 15 | 820 | 450 | 25 | 0.20 | — | — | — |
| | A16 | 16 | 830 | 450 | 25 | 0.20 | — | — | — |
| | A17 | 17 | 820 | 450 | 25 | 0.20 | — | — | — |
| | A18 | 1 | 850 | 450 | 25 | 0.11 | 860 | 900 | 0.6 |
| | A19 | 2 | 820 | 350 | 15 | 0.10 | — | — | — |
| | A20 | 6 | — | — | — | — | 870 | 950 | 0.5 |
| | A21 | 11 | 890 | 500 | 25 | 0.22 | — | — | — |
| | A22 | 15 | 820 | 450 | 25 | 0.20 | — | — | — |
| | A23 | 16 | 830 | 450 | 25 | 0.20 | 865 | 890 | 1.0 |
| | A24 | 17 | 830 | 450 | 25 | 0.20 | 865 | 930 | 1.0 |
| | A25 | 1 | — | — | — | — | 860 | 930 | 0.3 |
| | A26 | 6 | 820 | 350 | 15 | 0.10 | — | — | — |
| Comparative sample | B1 | 31 | 860 | 450 | 25 | 0.11 | — | — | — |
| | B2 | 32 | 850 | 450 | 25 | 0.11 | — | — | — |
| | B3 | 33 | 830 | 400 | 25 | 0.11 | — | — | — |
| | B4 | 34 | 860 | 500 | 25 | 0.12 | — | — | — |
| | B5 | 35 | 850 | 450 | 25 | 0.11 | — | — | — |
| | D6 | 36 | 300 | 500 | 30 | 0.18 | — | — | — |
| | B7 | 31 | — | — | — | — | 875 | 890 | 0.8 |
| | B8 | 38 | 850 | 450 | 25 | 0.11 | — | — | — |
| | B9 | 39 | 830 | 450 | 25 | 0.11 | — | — | — |

| | | | | Tempering | Area percentage of Mn micro-segregation (%) (Note 10) | | | Solute Mo, W | | |
|---|---|---|---|---|---|---|---|---|---|---|
| | Classification | Steel plate no. | Slab no. | temperature (° C.) (Note 9) | 1 mm from surface | 1/4 thickness | Thickness center | Solute Mo (%) | Solute W (%) | Solute Mo + W (%) |
| | Invention sample | A1 | 1 | | 8 | 9 | 13 | 0.021 | — | 0.021 |
| | | A2 | 2 | 400 | 10 | 12 | 18 | 0.026 | — | 0.026 |
| | | A3 | 3 | — | 5 | 4 | 7 | 0.039 | — | 0.039 |
| | | A4 | 4 | — | 7 | 8 | 8 | 0.030 | — | 0.030 |
| | | A5 | 5 | — | 11 | 13 | 20 | — | 0.031 | 0.031 |
| | | A6 | 6 | — | 6 | 8 | 10 | 0.012 | 0.025 | 0.037 |
| | | A7 | 7 | 450 | 7 | 6 | 7 | 0.028 | 0.055 | 0.083 |
| | | A8 | 8 | — | 3 | 5 | 5 | 0.024 | — | 0.024 |
| | | A9 | 9 | — | 7 | 7 | 8 | 0.022 | — | 0.022 |
| | | A10 | 10 | 400 | 2 | 4 | 3 | — | 0.019 | 0.019 |
| | | A11 | 11 | — | 6 | 8 | 9 | 0.023 | — | 0.023 |
| | | A12 | 12 | — | 5 | 9 | 9 | 0.026 | — | 0.026 |
| | | A13 | 13 | — | 5 | 6 | 6 | 0.010 | — | 0.010 |
| | | A14 | 14 | — | 9 | 8 | 10 | 0.028 | — | 0.028 |
| | | A15 | 15 | — | 6 | 8 | 11 | 0.028 | — | 0.029 |
| | | A16 | 16 | — | 5 | 7 | 10 | 0.014 | — | 0.014 |
| | | A17 | 17 | — | 7 | 9 | 10 | 0.021 | — | 0.021 |
| | | A18 | 1 | — | 8 | 3 | 12 | 0.015 | — | 0.015 |
| | | A19 | 2 | 400 | 4 | 5 | 6 | 0.024 | — | 0 024 |
| | | A20 | 6 | — | 4 | 4 | 7 | 0.013 | 0.019 | 0.032 |
| | | A21 | 11 | — | 8 | 9 | 15 | 0.024 | — | 0.024 |
| | | A22 | 15 | — | 5 | 7 | 8 | 0.030 | — | 0.030 |
| | | A23 | 16 | — | 5 | 7 | 10 | 0.012 | — | 0.012 |
| | | A24 | 17 | — | 4 | 5 | 8 | 0.018 | — | 0.018 |
| | | A25 | 1 | — | 9 | 10 | 15 | 0.002 | — | 0.002 |
| | | A26 | 6 | 600 | 6 | 7 | 9 | 0.002 | 0.002 | 0.004 |
| | Comparative sample | B1 | 31 | — | 14 | 15 | 19 | — | — | 0.000 |
| | | B2 | 32 | — | 15 | 15 | 22 | — | — | 0.000 |
| | | B3 | 33 | — | 10 | 9 | 10 | 0.010 | — | 0.010 |
| | | B4 | 34 | — | 8 | 9 | 16 | 0.019 | — | 0.019 |
| | | B5 | 35 | — | 10 | 17 | 20 | 0.021 | 0.014 | 0.035 |
| | | B6 | 36 | — | 8 | 8 | 10 | 0.012 | — | 0.012 |
| | | B7 | 37 | — | 10 | 11 | 15 | 0.025 | 0.018 | 0.043 |

TABLE 2-continued

| | | | | | | | | | |
|---|---|---|---|---|---|---|---|---|---|
| | B8 | 38 | — | 11 | 15 | 21 | 0.027 | — | 0.027 |
| | B9 | 39 | 500 | 9 | 10 | 14 | 0.030 | — | 0.030 |

Note 1
In "Converter - continuous casting," a slab may be as cast or breakdown rolled after casting. In "Vacuum melting - ingot casting," the thickness of every slab is equal to ingot thickness.
Note 2
AC: air cooling, FC: furnace cooling
Note 3
Measured values in hot working tests simulating history in actual rolling processes.
Note 4
No entry means air cooling without accelerated cooling.
Note 5
Average cooling rate from accelerated cooling end temperature to 100° C.
Note 6
No entry means no normalizing.
Note 7
$Ac_3$ transformation temperature under heating condition of normalizing.
Note 8
Average cooling rate in the range from 700° C. to 300° C.
Note 9
Cooling is air cooling. No entry means no tempering.
Note 10
Area percentage of those portions where Mn concentration is 1.2 times average Mn concentration or more in measurement of steel plate area 5 mm × 5 mm by X-ray microanalyzer.

TABLE 3

| Classification | Steel plate no. | Slab no. | Base material properties (Note 1) Yield stress (MPa) | Tensile strength (MPa) | Charpy vTrs (° C.) | Maximum hardness of weld (Hv) (Note 2) |
|---|---|---|---|---|---|---|
| Invention sample | A1 | 1 | 480 | 587 | −32 | 274 |
| | A2 | 2 | 526 | 615 | −48 | 321 |
| | A3 | 3 | 499 | 592 | −51 | 267 |
| | A4 | 4 | 367 | 498 | −30 | 202 |
| | A5 | 5 | 402 | 535 | −25 | 296 |
| | A6 | 6 | 351 | 499 | −31 | 235 |
| | A7 | 7 | 385 | 530 | −34 | 233 |
| | A8 | 8 | 619 | 734 | −69 | 230 |
| | A9 | 9 | 323 | 441 | −47 | 214 |
| | A10 | 10 | 299 | 436 | −68 | 190 |
| | A11 | 11 | 503 | 584 | −60 | 245 |
| | A12 | 12 | 517 | 592 | −57 | 223 |
| | A13 | 13 | 345 | 467 | −43 | 241 |
| | A14 | 14 | 502 | 589 | −66 | 232 |
| | A15 | 15 | 515 | 590 | −68 | 301 |
| | A16 | 16 | 497 | 583 | −70 | 236 |
| | A17 | 17 | 503 | 586 | −51 | 239 |
| | A18 | 1 | 354 | 496 | −28 | 272 |
| | A19 | 2 | 521 | 613 | −53 | 318 |
| | A20 | 6 | 349 | 489 | −35 | 230 |
| | A21 | 11 | 506 | 582 | −49 | 248 |
| | A22 | 15 | 516 | 592 | −70 | 297 |
| | A23 | 16 | 321 | 461 | −38 | 236 |
| | A24 | 17 | 328 | 475 | −36 | 235 |
| | A25 | 1 | 349 | 495 | −27 | 274 |
| | A26 | 6 | 503 | 602 | −56 | 237 |
| Comparative sample | B1 | 31 | 455 | 577 | −26 | 265 |
| | B2 | 32 | 503 | 622 | −58 | 322 |
| | B3 | 33 | 498 | 616 | −49 | 288 |
| | B4 | 34 | 618 | 697 | −17 | 296 |
| | B5 | 35 | 520 | 613 | −4 | 279 |
| | B6 | 36 | 519 | 624 | −8 | 280 |
| | B7 | 37 | 331 | 478 | −15 | 270 |
| | B8 | 38 | 509 | 615 | 22 | 285 |
| | B9 | 39 | 726 | 803 | 13 | 373 |

Note 1
Test pieces are cut out from thickness center at right angles to rolling direction.
Note 2
In conformity with JIS Z 3101

TABLE 4

| Classification | Steel plate no. | Slab no. | Relative corrosion rate (Note 1) Corrosion condition ① (Note 2) | Corrosion condition ② (Note 3) |
|---|---|---|---|---|
| Invention sample | A1 | 1 | 18.3 | 12.6 |
| | A2 | 2 | 19.1 | 13.8 |
| | A3 | 3 | 14.2 | 9.5 |
| | A4 | 4 | 16.8 | 11.9 |
| | A5 | 5 | 20.5 | 14.6 |
| | A6 | 6 | 15.0 | 9.9 |
| | A7 | 7 | 14.6 | 10.3 |
| | A8 | 8 | 14.3 | 10.1 |
| | A9 | 9 | 13.7 | 9.2 |
| | A10 | 10 | 16.4 | 11.5 |
| | A11 | 11 | 19.2 | 13.8 |
| | A12 | 12 | 16.1 | 11.0 |
| | A13 | 13 | 15.1 | 12.3 |
| | A14 | 14 | 17.3 | 13.4 |
| | A15 | 15 | 18.4 | 14.2 |
| | A16 | 16 | 16.4 | 15.2 |
| | A17 | 17 | 19.3 | 15.3 |
| | A18 | 1 | 15.8 | 14.9 |
| | A19 | 2 | 15.8 | 14.7 |
| | A20 | 6 | 17.0 | 15.9 |
| | A21 | 11 | 16.6 | 16.5 |
| | A22 | 15 | 16.3 | 15.3 |
| | A23 | 16 | 17.2 | 14.9 |
| | A24 | 17 | 18.1 | 16.8 |
| | A25 | 1 | 23.6 | 22.9 |
| | A26 | 6 | 24.0 | 23.1 |
| Comparative sample | B1 | 31 | 100 | 100 |
| | B2 | 32 | 86.0 | 87.0 |
| | B3 | 33 | 90.0 | 92.0 |
| | B4 | 34 | 109.0 | 122.0 |
| | B5 | 35 | 89.0 | 95.0 |
| | B6 | 36 | 43.0 | 43.0 |
| | B7 | 37 | 41.0 | 45.0 |

TABLE 4-continued

| Classification | Steel plate no. | Slab no. | Relative corrosion rate (Note 1) Corrosion condition ① (Note 2) | Corrosion condition ② (Note 3) |
|---|---|---|---|---|
| | B8 | 38 | 94.8 | 106.3 |
| | B9 | 39 | 92.6 | 95.7 |

Note 1

Relative values when the corrosion rate of comparative sample B1 is regarded as 100.

Corrosion rates of B1

Corrosion condition ①: 0.56 mg/cm$^2$/h.

Corrosion condition ②: 16.2 mg/cm$^2$/h.

Note 2

Corrosion condition ①: pH 0.5 (1 vol. % HCl + 10 mass % NaCl, 30° C. × 24 h.)

Note 3

Corrosion condition ②: pH 0.2 (1 vol. % HCl + 20 mass % NaCl, 30° C. × 24 h.)

TABLE 5

| Classification | Steel plate no. | Slab no. | Relative corrosion rate (Note 1) | Relative sludge formation rate (Note 2) |
|---|---|---|---|---|
| Invention sample | A1 | 1 | 25.1 | 24.0 |
| | A2 | 2 | 25.6 | 23.5 |
| | A3 | 3 | 23.4 | 21.9 |
| | A4 | 4 | 23.9 | 21.8 |
| | A5 | 5 | 24.0 | 22.0 |
| | A6 | 6 | 22.8 | 19.4 |
| | A7 | 7 | 21.7 | 17.7 |
| | A8 | 8 | 24.6 | 15.3 |
| | A9 | 9 | 25.0 | 15.1 |
| | A10 | 10 | 25.3 | 13.7 |
| | A11 | 11 | 25.0 | 23.8 |
| | A12 | 12 | 25.1 | 24.5 |
| | A13 | 13 | 23.0 | 19.6 |
| | A14 | 14 | 25.4 | 11.9 |
| | A15 | 15 | 24.3 | 19.4 |
| | A16 | 16 | 24.1 | 17.8 |
| | A17 | 17 | 24.9 | 17.3 |
| | A18 | 1 | 25.3 | 23.4 |
| | A19 | 2 | 53.9 | 23.3 |
| | A20 | 6 | 22.9 | 14.4 |
| | A21 | 11 | 24.4 | 17.3 |
| | A22 | 15 | 25.3 | 24.3 |
| | A23 | 16 | 25.1 | 24.3 |
| | A24 | 17 | 25.1 | 24.3 |
| | A25 | 1 | 25.1 | 24.4 |
| | A26 | 6 | 32.7 | 24.7 |
| Comparative sample | B1 | 31 | 100 | 100 |
| | B2 | 32 | 97.2 | 97.4 |
| | B3 | 33 | 98.3 | 100.2 |
| | B4 | 34 | 101.5 | 100.3 |
| | B5 | 35 | 106.2 | 110.5 |
| | B6 | 36 | 32.7 | 24.6 |
| | B7 | 37 | 25.1 | 24.3 |
| | B8 | 38 | 24.3 | 24.4 |
| | B9 | 39 | 25.7 | 26.9 |

Note 1

Relative values when the corrosion rate (0.54 mm/y) of comparative sample B1 is regarded as 100.

Note 2

Relative values when the mass of corrosion products containing precipitates of solid sulfur (1,260 mg/test piece) of comparative sample B1 is regarded as 100.

TABLE 6

| Gas components | $CO_2$ | $H_2S$ | $O_2$ | $N_2$ |
|---|---|---|---|---|
| Concentration | 12 vol. % | 500 ppm | 5 vol. % | Balance |

INDUSTRIAL APPLICABILITY

The present invention makes it possible to provide: a steel for a welded structure to be used for a crude oil tank, such as an oil tank of a crude oil carrier or an aboveground or underground crude oil tank, that exhibits excellent general and local corrosion resistance to crude oil corrosion caused in a steel oil tank for transporting or storing crude oil and is capable of suppressing the formation of corrosion products (sludge) containing solid sulfur; and such a crude oil tank. Therefore, the present invention contributes to the enhancement of the long-term reliability, safety, economical efficiency and so forth of a steel structure or a marine vessel, and brings about extremely significant industrial advantages.

The invention claimed is:

1. A crude oil tank, said crude oil tank being fabricated from a steel plate having a thickness of 40 mm or less and comprising, in mass, 0.001 to 0.2% C, 0.01 to 2.5% Si, 0.1 to 2% Mn, 0.03% or less P, 0.007% or less S, 0.1 to 1.5% Cu, 0.001 to 0.3% Al, 0.001 to 0.01% N, 0.03 to 01% Mo and optionally 0.01 to 0.5% W, satisfying the following expression, in mass %, $$\text{Solute Mo}+\text{Solute W}\geqq 0.005\%,$$

with the balance consisting of Fe and unavoidable impurities.

2. A crude oil tank according to claim 1, wherein the carbon equivalent (Ceq.) of the steel plate, in mass %, defined by the equation (1) is 0.4% or less;

$$\text{Ceq.}=C+Mn/6+(Cu+Ni)/15+(Cr+Mo+W+V)/5 \quad (1).$$

3. A crude oil tank according to claim 1 or 2, wherein the Cr content of the steel plate is less than 0.1 mass %.

4. A crude oil tank according to claim 1 or 2, wherein the steel plate contains, in mass, 0.1 to 3% Ni and/or 0.1 to 3% Co.

5. A crude oil tank according to claim 1 or 2, wherein the steel plate further contains, in mass, one or more of 0.01 to 0.3% Sb, 0.01 to 0.3% Sn, 0.01 to 0.3% Pb, 0.01 to 0.3% As and 0.01 to 0.3% Bi.

6. A crude oil tank according to claim 1 or 2, wherein the steel plate further contains, in mass, one or more of 0.002 to 0.2% Nb, 0.005 to 0.5% V, 0.002 to 0.2% Ti, 0.005 to 0.5% Ta, 0.005 to 0.5% Zr and 0.0002 to 0.005% B.

7. A crude oil tank according to claim 1 or 2, wherein the steel plate further contains, in mass, one or more of 0.0001 to 0.01% Mg, 0.0005 to 0.01% Ca, 0.0001 to 0.1% Y, 0.005 to 0.1% La and 0.005 to 0.1% Ce.

8. A crude oil tank according to claim 1, wherein the area percentage of microscopic segregation portions where the Mn concentration is 1.2 times or more the average Mn concentration in the steel plate is 10% or less.

9. A crude oil tank according to claim 3, characterized by the steel plate further containing, in mass, 0.1 to 3% Ni and/or 0.1 to 3% Co.

10. A crude oil tank according to claim 3, characterized by the steel plate further containing, in mass, one or more of 0.01 to 0.3% Sb, 0.01 to 0.3% Sn, 0.01 to 0.3% Pb, 0.01 to 0.3% As and 0.01 to 0.3% Bi.

11. A crude oil tank according to claim 4, characterized by the steel plate further containing, in mass, one or more of 0.01 to 0.3% Sb, 0.01 to 0.3% Sn, 0.01 to 0.3% Pb, 0.01 to 0.3% As and 0.01 to 0.3% Bi.

12. A crude oil tank according to claim 3, characterized by the steel plate further containing, in mass, one or more of 0.002 to 0.2% Nb, 0.005 to 0.5% V, 0.002 to 0.2% Ti, 0.005 to 0.5% Ta, 0.005 to 0.5% Zr and 0.0002 to 0.005% B.

13. A crude oil tank according to claim 4, characterized by the steel plate further containing, in mass, one or more of 0.002 to 0.2% Nb, 0.005 to 0.5% V, 0.002 to 0.2% Ti, 0.005 to 0.5% Ta, 0.005 to 0.5% Zr and 0.0002 to 0.005% B.

14. A crude oil tank according to claim 5, characterized by the steel plate further containing, in mass, one or more of 0.002 to 0.2% Nb, 0.005 to 0.5% V, 0.002 to 0.2% Ti, 0.005 to 0.5% Ta, 0.005 to 0.5% Zr and 0.0002 to 0.005% B.

15. A crude oil tank according to claim 3, characterized by the steel plate further containing, in mass, one or more of 0.0001 to 0.01% Mg, 0.0005 to 0.01% Ca, 0.0001 to 0.1% Y, 0.005 to 0.1% La and 0.005 to 0.1% Ce.

16. A crude oil tank according to claim 4, characterized by the steel plate further containing, in mass, one or more of 0.0001 to 0.01% Mg, 0.0005 to 0.01% Ca, 0.0001 to 0.1% Y, 0.005 to 0.1% La and 0.005 to 0.1% Ce.

17. A crude oil tank according to claim 1, characterized by the steel plate further containing, in mass, 0.03 to 0.08% Mo.

18. A crude oil tank according to claim 1, characterized by the steel plate further containing, in mass, 0.03 to 0.07% Mo.

* * * * *